US011500322B2

(12) United States Patent
Shinoya et al.

(10) Patent No.: US 11,500,322 B2
(45) Date of Patent: Nov. 15, 2022

(54) IMAGE FORMING APPARATUS

(71) Applicant: BROTHER KOGYO KABUSHIKI KAISHA, Nagoya (JP)

(72) Inventors: Shota Shinoya, Nisshin (JP); Isao Kishi, Nagoya (JP)

(73) Assignee: BROTHER KOGYO KABUSHIKI KAISHA, Nagoya (JP)

( * ) Notice: Subject to any disclaimer, the term of this patent is extended or adjusted under 35 U.S.C. 154(b) by 0 days.

(21) Appl. No.: 17/231,086

(22) Filed: Apr. 15, 2021

(65) Prior Publication Data

US 2021/0232083 A1 Jul. 29, 2021

Related U.S. Application Data

(63) Continuation of application No. 16/786,385, filed on Feb. 10, 2020, now Pat. No. 10,996,615.

(30) Foreign Application Priority Data

Feb. 22, 2019 (JP) ..... JP2019-030993

(51) Int. Cl.
*G03G 15/00* (2006.01)
*G03G 21/16* (2006.01)
*G03G 15/08* (2006.01)

(52) U.S. Cl.
CPC ..... *G03G 21/1633* (2013.01); *G03G 15/0863* (2013.01); *G03G 21/1619* (2013.01); *G03G 2221/1684* (2013.01)

(58) Field of Classification Search
CPC ..... G03G 15/0863; G03G 21/1619; G03G 21/1633
USPC ..... 399/107, 110, 111
See application file for complete search history.

(56) References Cited

U.S. PATENT DOCUMENTS

| | | | |
|---|---|---|---|
| 9,581,960 | B2 | 2/2017 | Hashimoto et al. |
| 2010/0135693 | A1 | 6/2010 | Okabe et al. |
| 2019/0041792 | A1 | 2/2019 | Kishi et al. |

FOREIGN PATENT DOCUMENTS

| | | | |
|---|---|---|---|
| CN | 1162776 | A | * 10/1997 |
| CN | 104090471 | A | 10/2014 |
| JP | 2010-128336 | A | 6/2010 |
| JP | 2015-060102 | A | 3/2015 |
| JP | 2019-28345 | A | 2/2019 |

* cited by examiner

*Primary Examiner* — Hoan H Tran
(74) *Attorney, Agent, or Firm* — Merchant & Gould P.C.

(57) ABSTRACT

An image forming apparatus includes a drawer and a main body. The drawer includes a drawer-side electrical contact part and a socket. The main body includes a main body-side connector including: a main body-side electrical contact part; and a holder including a base, a panel, and an elastic member interposed between the base and the panel. The holder holds the main body-side electrical contact part to be movable in an intersection direction intersecting with an extension and contraction direction of the elastic member. When the holder contacts the socket, the panel moves relative to the base in the intersection direction together with the main body side-electrical contact part, and the main body side-electrical contact part and drawer-side electrical contact part are in contact with each other.

16 Claims, 18 Drawing Sheets

2/18

※ L1 < L2

IMAGE FORMING APPARATUS

CROSS-REFERENCE TO RELATED APPLICATIONS

This application is a continuation of U.S. patent application Ser. No. 16/786,385 which was filed on 10 Feb. 2020, now U.S. Pat. No. 10,996,615, which claims priority from Japanese Patent Application No. 2019-030993 filed on 22 Feb. 2019, the entire subject matter of each of which are incorporated herein by reference.

TECHNICAL FIELD

The present disclosure relates to an image forming apparatus.

BACKGROUND

There has been proposed an electrophotographic image forming apparatus such as a laser printer and an LED printer. The related-art image forming apparatus includes a drawer. The drawer includes a plurality of photosensitive drums. A plurality of developing cartridges is removably insertable to the drawer. When the developing cartridges are inserted to the drawer, developing rollers of the developing cartridges and the photosensitive drums of the drawer are contacted to each other. The drawer having the developing cartridges inserted thereto is accommodated in a housing of an image forming apparatus main body.

SUMMARY

Illustrative aspects of the present disclosure provide an image forming apparatus capable of, even when there is an error in positional relation between an electrical contact part on a drawer-side and an electrical contact part on an image forming apparatus main body-side, electrically connecting a storage medium on the drawer-side to a controller of an image forming apparatus main body with accuracy and ease via the electrical contact part on the drawer-side and the electrical contact part on the image forming apparatus main body-side.

According to one illustrative aspect of the present disclosure, an image forming apparatus configured as described below is provided. That is, an image forming apparatus may comprise a drawer and an image forming apparatus main body. The drawer may comprise: a frame configured to hold a plurality of photosensitive drums while spacing the plurality of photosensitive drums at intervals in a second direction, each of the plurality of the photosensitive drums being rotatable about an axis extending in a first direction; a drawer memory storing at least one of information about at least one of the plurality of photosensitive drums and information about developing cartridges removably insertable to the frame; and a drawer-side connector located at an outer surface of the frame on one side in the second direction, the drawer-side connector comprising: a drawer-side electrical contact part electrically connected to the drawer memory; and a socket configured to hold therein the drawer-side electrical contact part. The image forming apparatus main body may comprise: a housing having an internal space, the drawer being accommodated in the internal space by moving the drawer relative to the housing in an insertion direction; a controller; and a main body-side connector comprising: a main body-side electrical contact part electrically connected to the controller, the main body-side electrical contact part being contactable the drawer-side electrical contact part in case the drawer is inserted in the housing; and a holder. The holder may comprise: a base; a panel, the main body-side electrical contact part being fixed to the panel; and an elastic member interposed between the base and the panel, the holder being configured to hold the main body-side electrical contact part to be movable in an intersection direction intersecting with an extension and contraction direction of the elastic member. In a case the holder is in contact with the socket of the drawer-side connector, the panel may move relative to the base in the intersection direction together with the main body side-electrical contact part, and the main body side-electrical contact part and drawer-side electrical contact part may be in contact with each other.

According thereto, the image forming apparatus capable of electrically connecting the storage medium on the drawer-side to the controller of the image forming apparatus main body with accuracy and ease via the electrical contact part on the drawer-side and the electrical contact part on the image forming apparatus main body-side may be provided.

BRIEF DESCRIPTION OF DRAWINGS

Illustrative embodiments of the disclosure will be described in detail based on the following figures, wherein.

DETAILED DESCRIPTION

In the related art, a developing cartridge including a storage medium is known. In the storage medium, a variety of information about the developing cartridge is stored. Also, in the drawer, a variety of information about the photosensitive drum is handled. For this reason, the drawer is also required to mount a storage medium in which the variety of information about the photosensitive drum is stored. Not only in a case in which the storage medium having the information about the photosensitive drum stored therein is mounted to the drawer and but also in a case in which a storage medium having information about a developing cartridge stored therein is mounted to the drawer via the developing cartridge, the storage media are required to be electrically connected to an image forming apparatus main body-side controller.

However, in the case in which the drawer is accommodated in the housing of the image forming apparatus main body, an error may occur in a positional relation between an electrical contact part on the drawer-side and an electrical contact part on the image forming apparatus main body-side. In this case, the electrical contact part on the drawer-side and the electrical contact part on the image forming apparatus main body-side may not be smoothly connected.

Therefore, illustrative aspects of the present disclosure provide an image forming apparatus capable of, even when there is an error in positional relation between an electrical contact part on a drawer-side and an electrical contact part on an image forming apparatus main body-side, electrically connecting a storage medium on the drawer-side to a controller of an image forming apparatus main body with accuracy and ease via the electrical contact part on the drawer-side and the electrical contact part on the image forming apparatus main body-side.

Hereinbelow, an illustrative embodiment of the present disclosure will be described with reference to the accompanying drawings.

In descriptions below, a direction in which an axis of rotation center (drum axis) of a photosensitive drum extends is referred to as "first direction". Also, a direction in which a plurality of photosensitive drums is aligned is referred to as "second direction". The first direction and the second direction intersect with each other, and are preferably orthogonal to each other. Also, a direction in which a socket extends is referred to as "third direction". Also, the third direction is preferably a direction orthogonal to the first direction and including the second direction as a component. Also, a direction perpendicular to the first direction and the third direction is referred to as "fourth direction".

<1. Configuration of Image Forming Apparatus>

Figure 1:
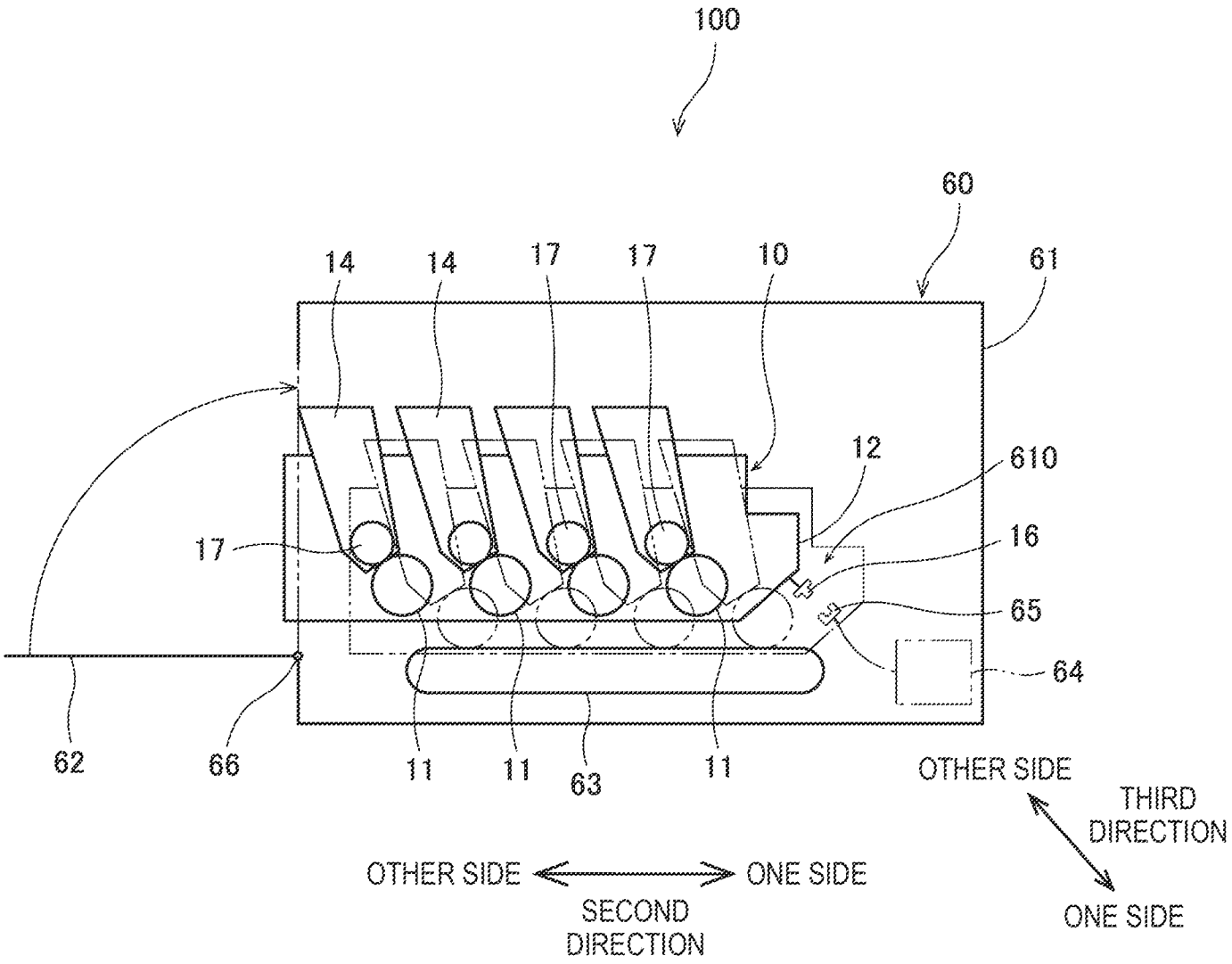
FIG. 1 is a schematic view of an image forming apparatus.
Figure 2:
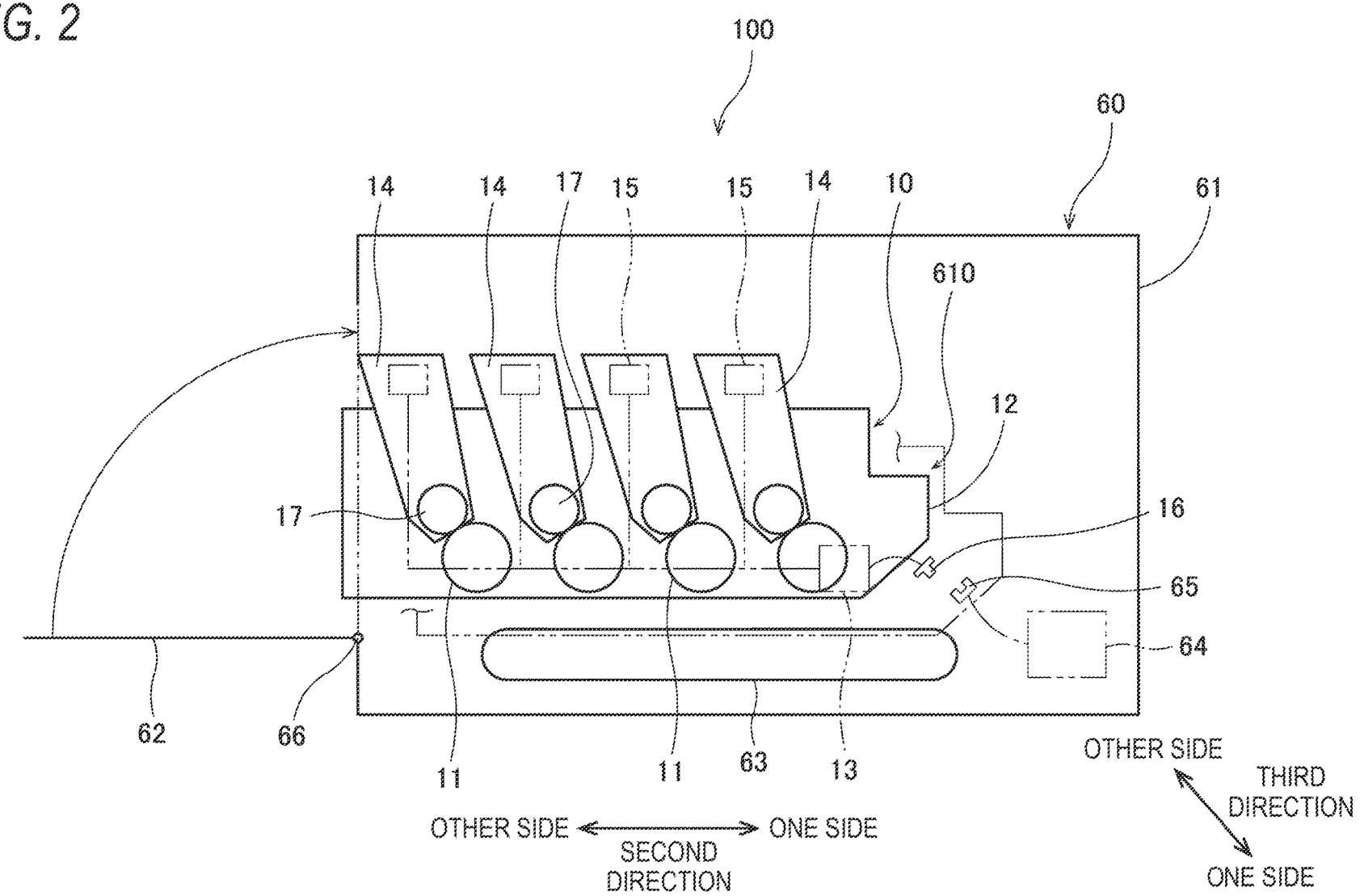
FIG. 2 is a schematic view of the image forming apparatus.

FIGS. 1 and 2 are schematic views of an image forming apparatus 100. The image forming apparatus 100 is an electrophotographic printer. As the image forming apparatus, a laser printer or an LED printer may be exemplified. As shown in FIGS. 1 and 2, the image forming apparatus 100 includes a drawer 10, and an image forming apparatus main body 60.

<1-1. Configuration of Drawer>

Figure 3:
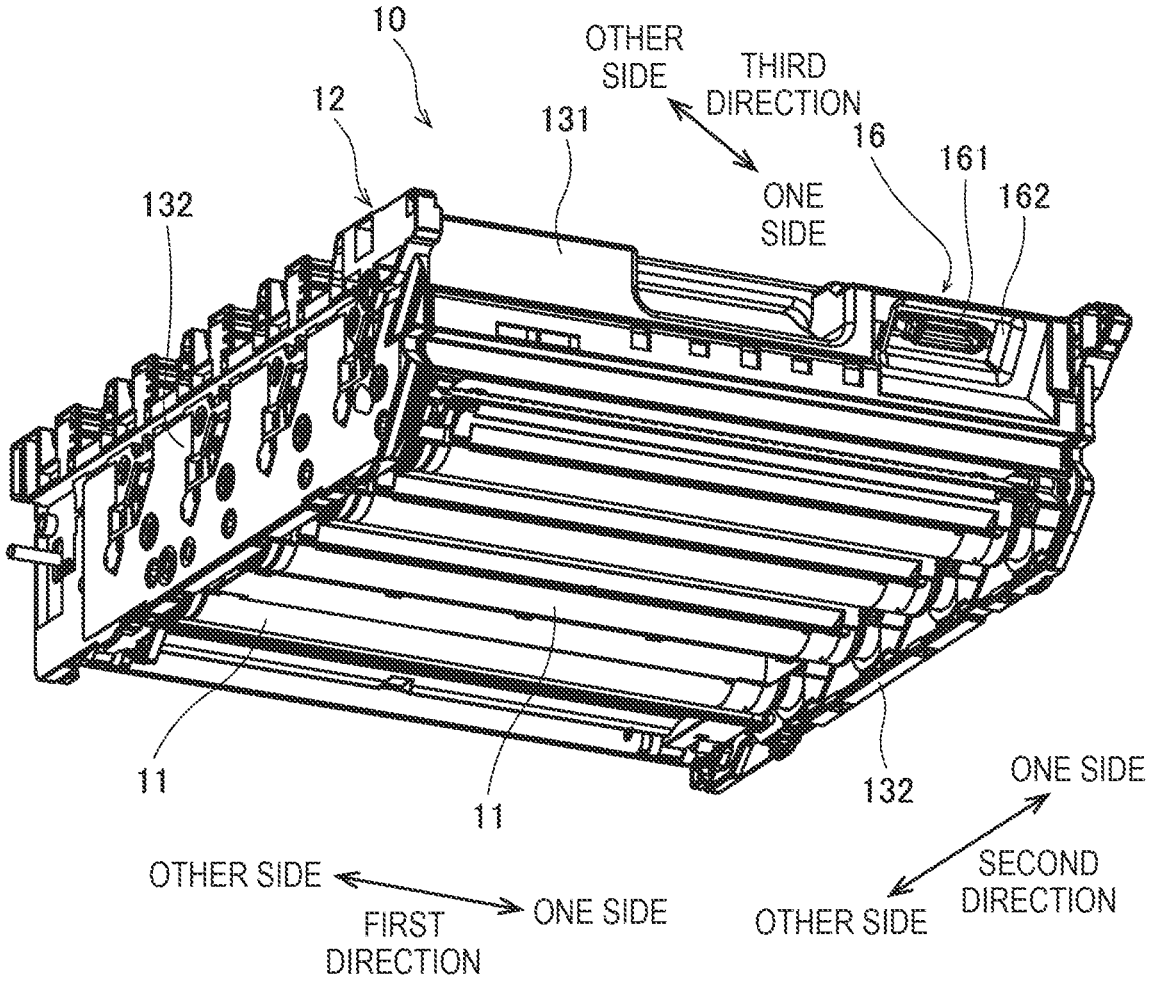
FIG. 3 is a perspective view of a drawer.
Figure 4:
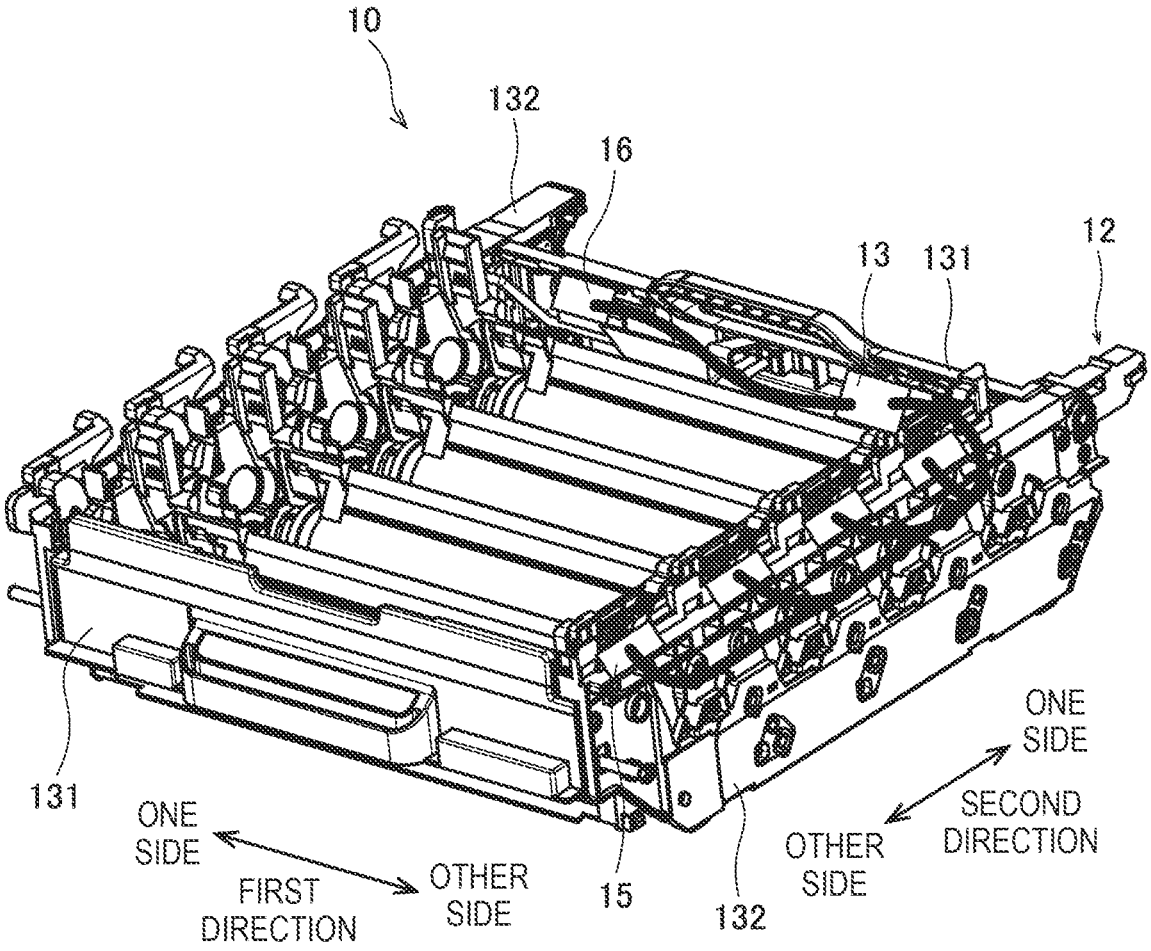
FIG. 4 is a perspective view of the drawer.

In the below, a configuration of the drawer 10 is described. FIGS. 3 and 4 are perspective views of the drawer 10. As shown in FIGS. 1 to 4, the drawer 10 includes four photosensitive drums 11, a frame 12, a drum memory (drawer memory) 13, four developing cartridges 14, four toner memories (drawer memory) 15, and a drawer-side connector 16.

As shown in FIGS. 3 and 4, each of the four photosensitive drums 11 has a cylindrical outer peripheral surface of which a center is a drum axis, which is an axis of rotation center extending in the first direction. The outer peripheral surface of the photosensitive drum 11 is covered with a photosensitive material. Also, each of the four photosensitive drums 11 is rotatable about the drum axis.

As shown in FIGS. 3 and 4, the frame 12 is a frame body configured to support the four photosensitive drums 11. The frame 12 is configured to hold the plurality of photosensitive drums 11 while spacing the same in the second direction. The frame 12 has a pair of the base plates 131 facing in the second direction, and a pair of side plates 132 facing in the first direction.

As shown in FIGS. 1 and 2, the developing cartridge 14 is removably insertable to the frame 12. The developing cartridge 14 has a housing in which toner, which is developing agent, can be accommodated. The four developing cartridges 14 accommodate therein toners of different colors (for example, cyan, magenta, yellow and black). Also, in the present illustrative embodiment, the developing cartridge 14 has a developing roller 17. The developing roller 17 is a cylindrical member. The developing roller 17 is rotatable about a developing axis, which is an axis of rotation center extending in the first direction. When the developing cartridge 14 is inserted to the frame 12, the outer peripheral surface of the photosensitive drum 11 is in contact with an outer peripheral surface of the developing roller 17.

The drum memory 13, the toner memory 15, and the drawer-side connector 16 will be described in detail later.

<1-2. Configuration of Image Forming Apparatus Main Body>

In the below, a configuration of the image forming apparatus main body 60 is described. As shown in FIGS. 1 and 2, the image forming apparatus main body 60 includes a housing 61, a cover 62, a transfer belt 63, a controller 64, and a main body-side connector 65.

The housing 61 has a substantial cuboid shape, and includes an internal space 610. In the internal space 610 of the housing 61, the drawer 10 can be accommodated by moving the same relative to the housing 61 in an insertion direction. In the present illustrative embodiment, the "insertion direction" is a direction facing toward one side in the second direction. Like this, the drawer 10 having the developing cartridges 14 inserted thereto is accommodated in the housing 61. In addition, in the housing 61, four chargers (not shown), four light sources (not shown), the transfer belt 63, the controller 64, and the main body-side connector 65 are accommodated.

The cover 62 can move between an open position shown with the solid line in FIG. 1 and a closed position shown with the dashed-two dotted line in FIG. 1. Specifically, the cover 62 can rotate about a hinge 66 extending in the first direction. When the cover 62 is arranged in the open position, the internal space 610 of the housing 61 is opened. When the cover 62 is arranged in the closed position, the internal space 610 of the housing 61 is closed.

A user of the image forming apparatus 100 is movable the drawer 10 having the developing cartridges 14 inserted thereto in the insertion direction, in a state in which the cover 62 is located in the open position. Thereby, the drawer 10 is movable between a separation position in which at least a part thereof is located outside of the housing 61 and an installation position in which the drawer is set in the internal space 610.

The transfer belt 63 is an endless band-shaped belt for conveying a print sheet. The transfer belt 63 is positioned on an opposite side to the developing rollers 17 with the photosensitive drums 11 being interposed therebetween, in a state in which the drawer 10 is arranged in the installation position. An outer peripheral surface of the transfer belt 63 is contactable the outer peripheral surfaces of the photosensitive drums 11 in a state in which the drawer 10 is arranged in the installation position.

The controller 64 includes a processor such as a CPU, and a main body memory.

The main body memory is a recording medium from and into which information can be read and written. The main body memory is, for example, a flash ROM or EEPROM. In the main body memory, a computer program for controlling operations of the image forming apparatus 100 is stored. The processor is configured to execute a variety of processing according to the computer program stored in the main body memory. That is, the processor is configured to execute printing processing of the image forming apparatus 100 and a variety of processing associated therewith.

The main body-side connector 65 will be described in detail later.

<1-3. Configuration Relating to Electrical Connection>

In the below, a configuration of electrical connection of the image forming apparatus 100 is described. Specifically, the drum memory 13, the toner memory 15, the drawer-side connector 16, and the main body-side connector 65 are described with reference to FIGS. 2 and 4.

<1-3-1. Configuration Relating to Electrical Connection of Drawer>

The drawer 10 has, as a configuration relating to electrical connection, the drum memory 13, the toner memory 15, and the drawer-side connector 16.

In the drum memory 13, information about at least one of the four photosensitive drums 11 is stored. Specifically, in the drum memory 13 of the present illustrative embodiment, drum identification information capable of identifying each photosensitive drum 11 and drum life-span information about life-span of the photosensitive drum 11 are stored. The drum identification information is, for example, a serial number. The drum life-span information is at least one of the number of rotations of the photosensitive drum 11 and the number of prints of the photosensitive drum 11. As shown in FIG. 4, the drum memory 13 of the present illustrative embodiment is positioned at an inner surface of the base plate 131, which is located at one side in the second direction, of the pair of the base plates 131. The drum memory 13 is configured to relay electrical connection between the toner memory 15 and the drawer-side connector 16, which will be described later.

The toner memory 15 is individually provided to each developing cartridge 14. In the toner memory 15, toner identification information capable of identifying each developing cartridge 14 and toner life-span information about life-span of the developing cartridge 14 are stored. The toner identification information is, for example, a serial number. The toner life-span information is at least one of the number of rotations of the developing roller 17, the number of prints of the developing roller 17, and the number of output dots. In a state in which the developing cartridge 14 is inserted to the drawer 10, the toner memory 15 of the present illustrative embodiment is positioned on an outer surface of the side plate 132, which is located on the other side in the first direction, of the pair of side plates 132.

As shown in FIG. 3, the drawer-side connector 16 is located on an outer surface of the base plate 131, which is located at one side in the second direction, of the pair of the base plates 131. The drawer-side connector 16 includes a drawer-side electrical contact part 161, and a socket 162. A plurality of electrical contact surfaces is aligned on the drawer-side electrical contact part 161. Any one of wirings such as a voltage line, a clock line, a data line and the like extends on each of the electrical contact surfaces, and the wirings are connected to the drum memory 13. Also, the wirings are electrically connected to the corresponding toner memories 15 via the drum memory 13. The wirings are appropriately bundled to form a harness. In this way, the drawer-side electrical contact part 161 is electrically connected to the drum memory 13 and the toner memories 15.

When the drawer-side connector 16 is connected to the main body-side connector 65, which will be described later, the drum memory 13 and toner memories 15, and the controller 64 are electrically connected. Thereby, the controller 64 can perform communication with the drum memory 13 and the toner memories 15.

The socket 162 shown in FIG. 3 extends in the third direction. The socket 162 is configured to hold therein the drawer-side electrical contact part 161. That is, the socket 162 is configured to surround the drawer-side electrical contact part 161. The socket 162 has such a shape that it gradually converges as it comes closer to the drawer-side electrical contact part 161 in the third direction. In other words, the socket 162 becomes wider so that it is more distant from the drawer-side electrical contact part 161 toward one side in the third direction.

<1-3-2. Configuration Relating to Electrical Connection of Image Forming Apparatus Main Body>

Figure 5:
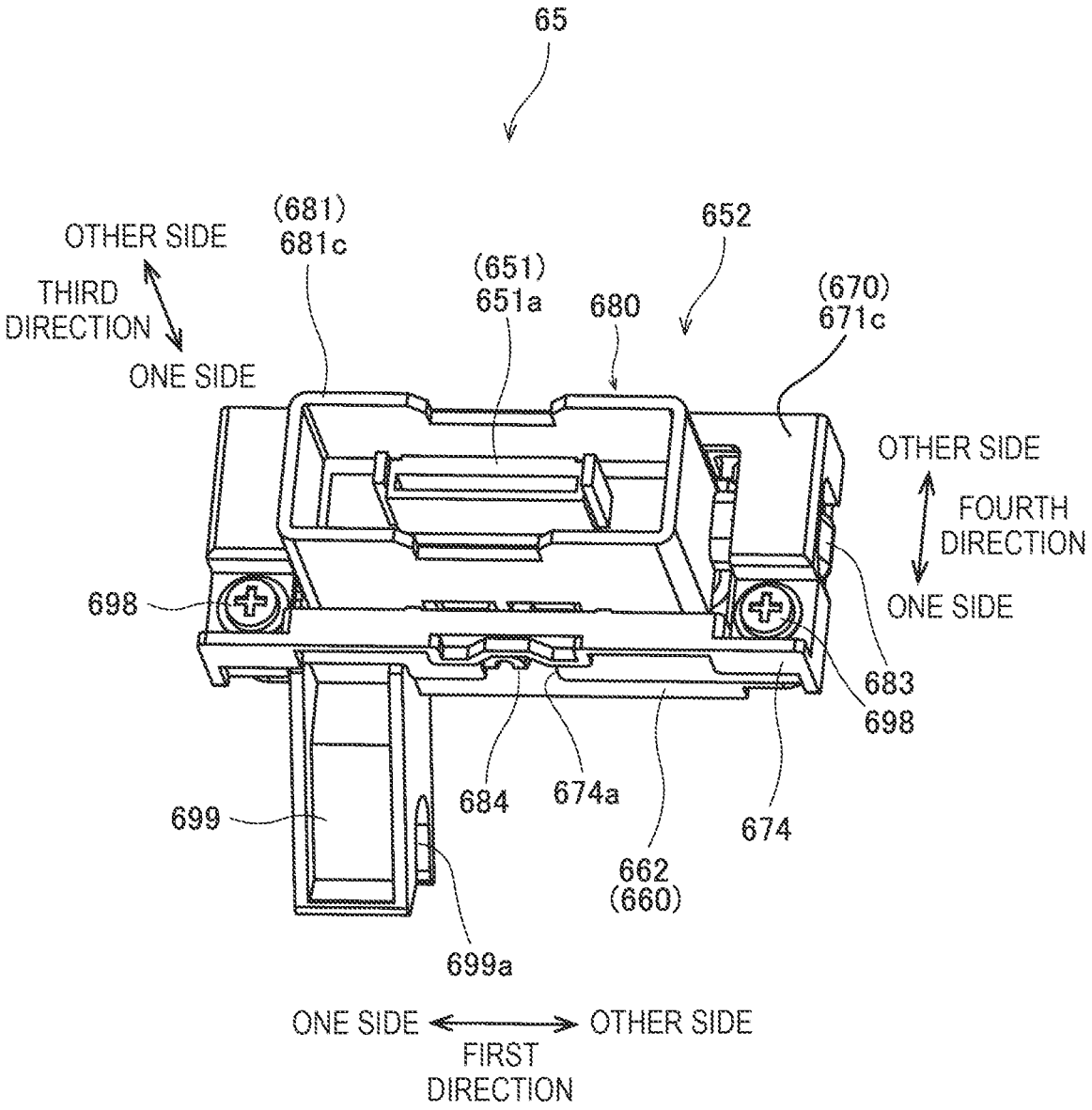
FIG. 5 is a perspective view of a main body-side connector.

FIG. 5 is a perspective view of the main body-side connector 65. As shown in FIG. 5, the main body-side connector 65 includes a main body-side electrical contact part 651, and a holder 652. A plurality of electric contact points is aligned at the main body-side electrical contact part 651. From each of the electric contact points, any one of wirings such as a voltage line, a clock line, a data line and the like extends. The wirings are connected to corresponding terminals of the controller 64. The wirings are appropriately bundled to form a harness. In this way, the main body-side electrical contact part 651 is electrically connected to the controller 64.

When the drawer 10 is inserted into the internal space 610 of the housing 61 and is thus arranged in the installation position, the main body-side connector 65 and the drawer-side connector 16 are interconnected. Thereby, each electrical contact surface of the drawer-side electrical contact part 161 is contacted to the corresponding electric contact point of the main body-side electrical contact part 651.

The holder 652 is configured to hold the main body-side electrical contact part 651 so as to be movable in the third direction and in a direction intersecting with the third direction. The direction intersecting with the third direction is the fourth direction, for example. In the present illustrative embodiment, the holder 652 is configured to hold the main body-side electrical contact part 651 so as to be movable, i.e., floatable in the third direction and in a direction orthogonal to the third direction. The specific configuration of the holder 652 will be described later.

In the image forming apparatus 100 configured as described above, upon execution of printing processing, the controller 64 is configured to drive a motor (not shown). The photosensitive drums 11 and the developing rollers 17 are configured to rotate by drive of the motor. Also, the controller 64 is configured to electrically charge surfaces of the photosensitive drums 11 by feeding power to the chargers. Also, the controller 64 is configured to cause the light sources to emit lights, thereby irradiating the lights from the light sources toward the outer peripheral surfaces of the photosensitive drums 11. Thereby, electrostatic latent images of an image to be printed are formed on the outer peripheral surfaces of the photosensitive drums 11. The toners of the developing cartridges 14 are supplied onto the electrostatic latent images on the photosensitive drums 11 via the developing rollers 17. Thereby, toner images are formed on the outer peripheral surfaces of the photosensitive drums 11. Thereafter, the print sheet is conveyed between the photosensitive drums 11 and the transfer belt 63. Thereby, the toner images are transferred from the outer peripheral surfaces of the photosensitive drums 11 to the print sheet. In the state in which the toner images have been transferred to the print sheet, the print sheet is conveyed to a fixing device in the image forming apparatus 100. Thereby, the toner images transferred to the print sheet are heat-fixed on the print sheet. As a result, an image is printed on the print sheet.

In the meantime, upon execution of the printing processing, the controller 64 is configured to perform communication with the drum memory 13 and the toner memories 15, thereby acquiring the information about the life-span of the photosensitive drums 11 and the life-span of the developing cartridges 14, for example. Thereby, the controller 64 can set a favorable mode to execute the printing processing or stop the printing processing, depending on situations.

<1-4. Detailed Configurations of Respective Components of Main Body-Side Connector>

In the below, a configuration of the main body-side connector 65, particularly, a detailed description of the holder 652 are described with reference to FIGS. 5 to 18. As shown in FIG. 5, the holder 652 includes a base 660, a cover 670, a panel 680, and coil springs (elastic member) 690 (refer to FIG. 6).

<1-4-1. Configuration of Base>

Figure 6:
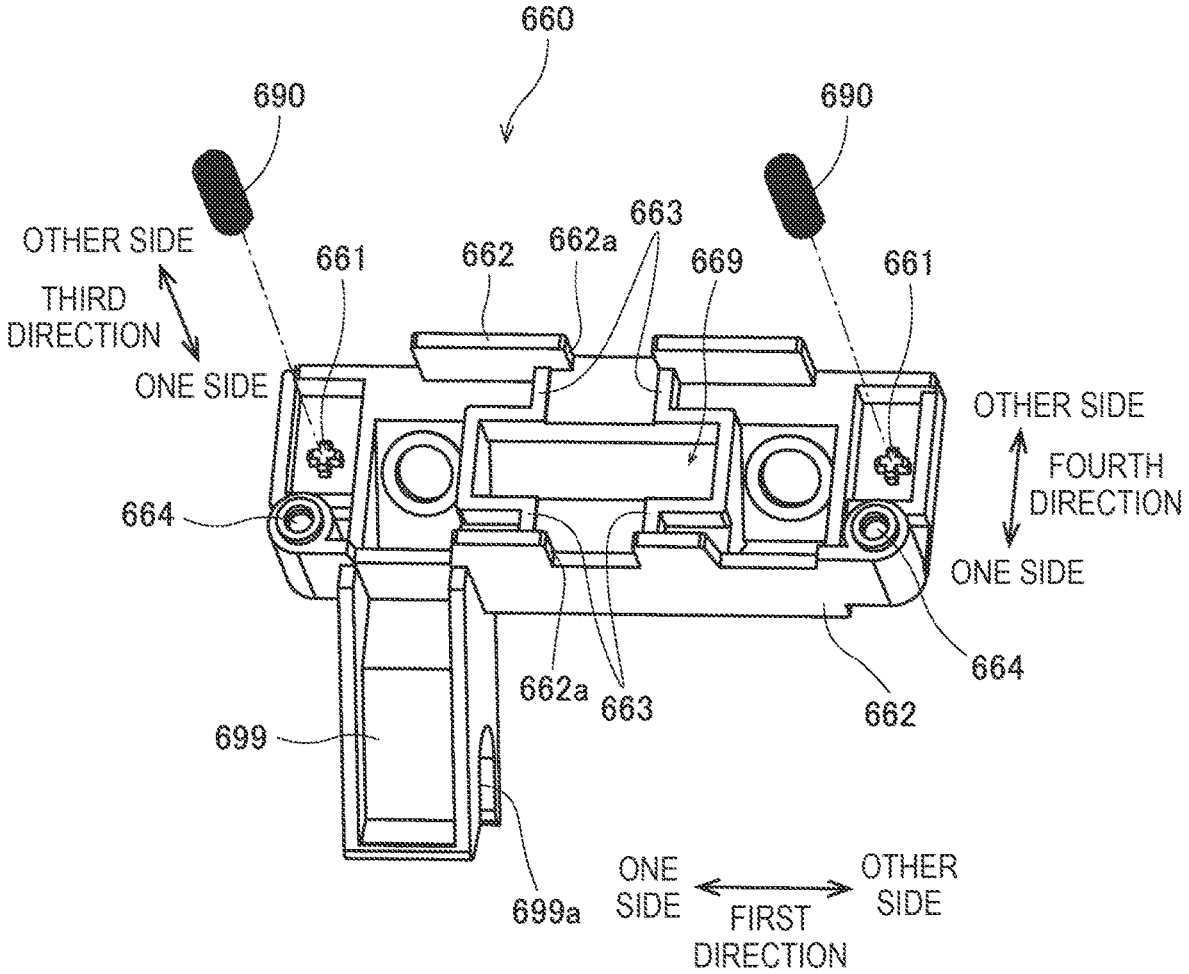
FIG. 6 is a perspective view of a base.
Figure 7:
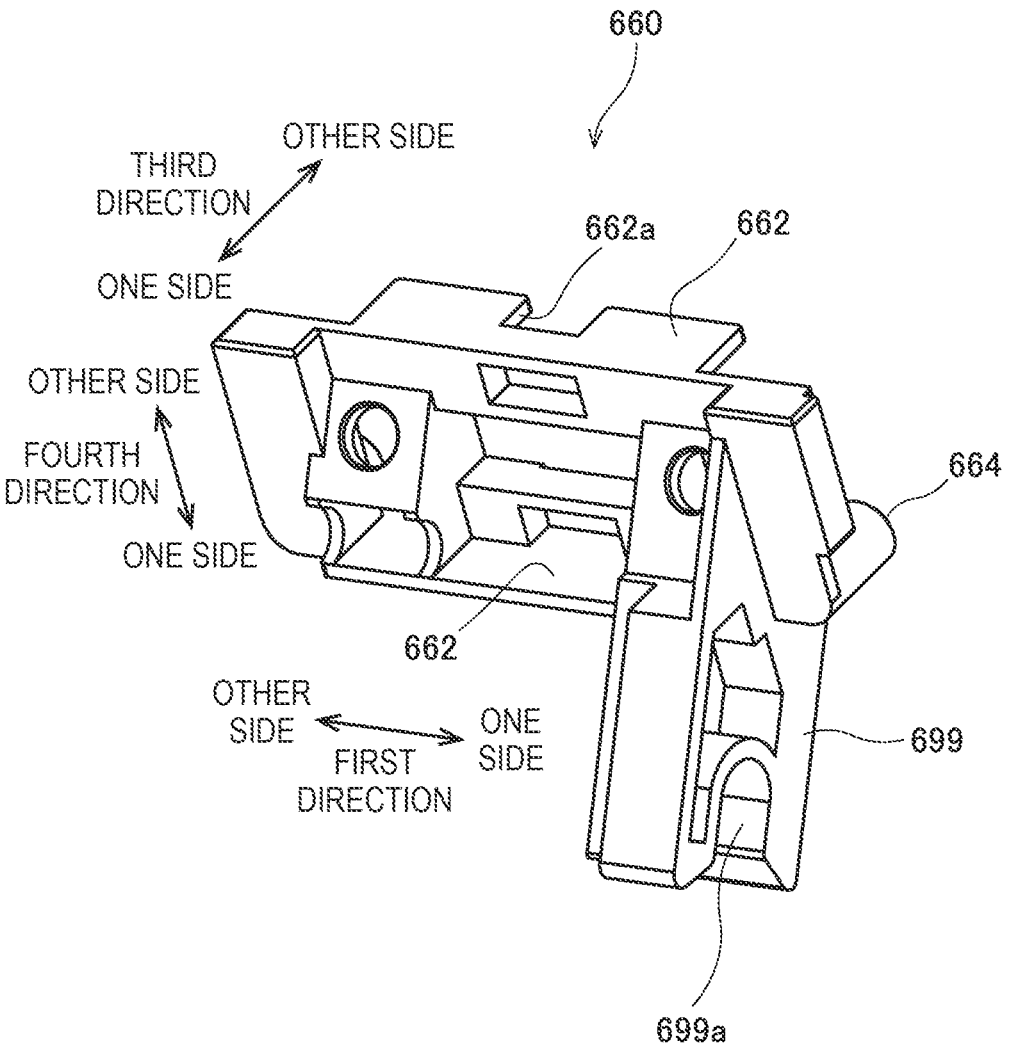
FIG. 7 is a perspective view of the base.

First, a configuration of the base 660 is described with reference to FIGS. 6 and 7. FIG. 6 is a perspective view of the base 660 and the coil springs 690. FIG. 7 is a perspective view of the base 660, as seen in a direction different from FIG. 6.

The base 660 has a rectangular shape, as seen in the third direction. The base 660 has an attachment part 699. The attachment part 699 is used to attach the base 660 to a reference shaft (not shown) extending in the first direction in the internal space 610 of the housing 61. The attachment part 699 has a notch 699*a*. The reference shaft is fitted in the notch 699*a*. The base 660 has a through-hole 669 penetrating a central portion of the rectangular shape in the third direction. An inner peripheral surface of the through-hole 669 has a rectangular shape having long sides and short sides, as seen in the third direction.

The base 660 has first spring seats 661 on an outer surface on the other side in the third direction. One end of the coil spring 690 (which will be described later) in the third direction is connected to the first spring seat 661. The first spring seats 661 are arranged at two places, i.e., one side of the through-hole 669 in the first direction and the other side of the through-hole 669 in the first direction with the through-hole 669 being interposed therebetween.

The base 660 has a pair of end walls 662 facing each other in the fourth direction. Each end wall 662 extends perpendicularly to the fourth direction. A central portion of the end wall 662 in the first direction is provided with a rectangular notch 662*a* opening toward the other side in the third direction.

Also, the base 660 has a first contact surface 663 protruding in a rib shape on the outer surface on the other side in the third direction. The first contact surface 663 is a flat surface-shaped part perpendicular to the third direction. The first contact surface 663 extends in the fourth direction from parts of the long sides of the through-hole 669. The first contact surface 663 more protrudes toward the other side in the third direction than a region adjacent in the first direction.

Also, the base 660 has opened screw holes 664 on the outer surface on the other side in the third direction. The screw hole 664 extends toward one side in the third direction. The screw hole 664 has a female screw on an inner peripheral surface thereof.

<1-4-2. Configuration of Cover>

Figure 8:
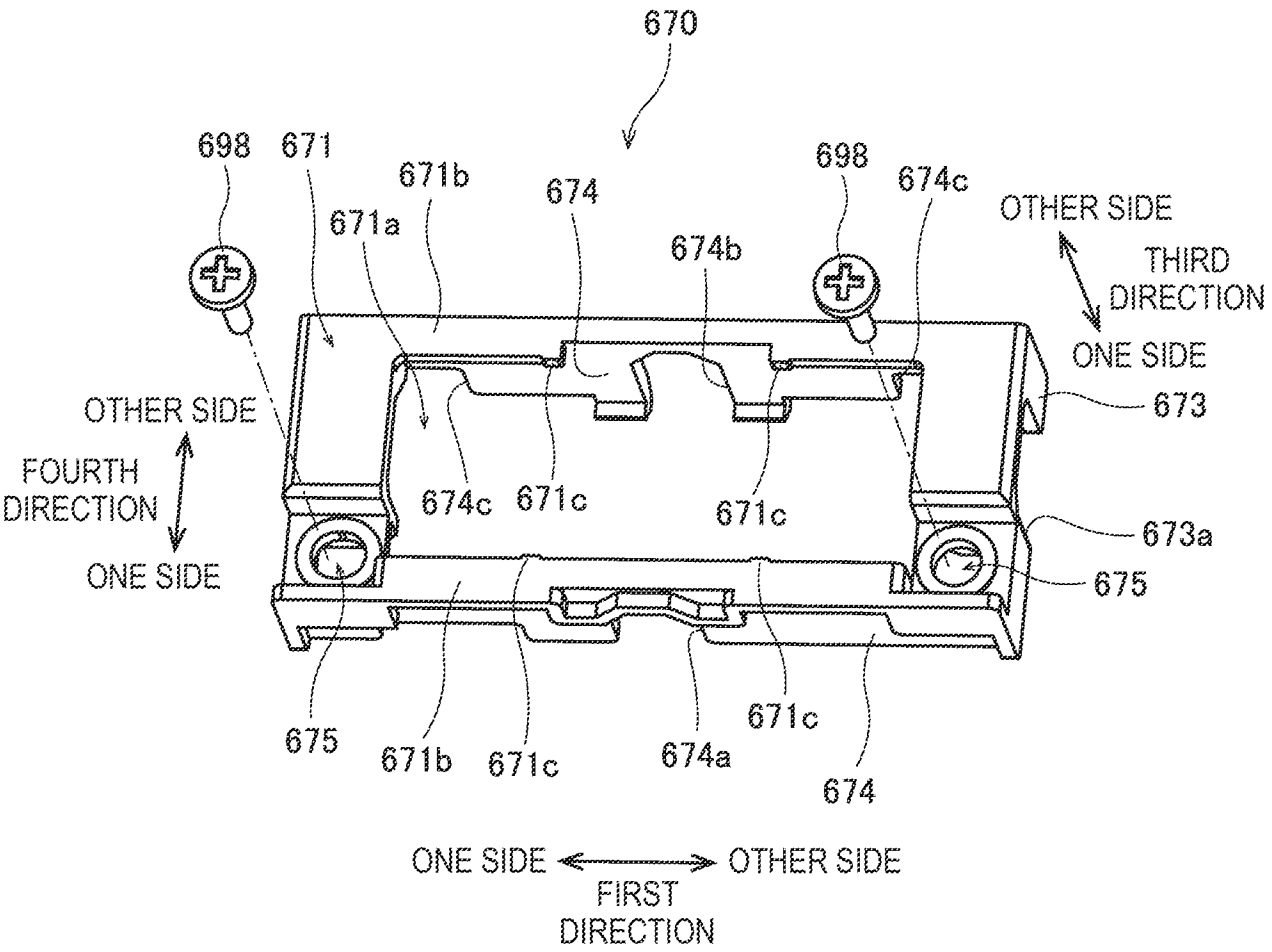
FIG. 8 is a perspective view of a cover.
Figure 9:
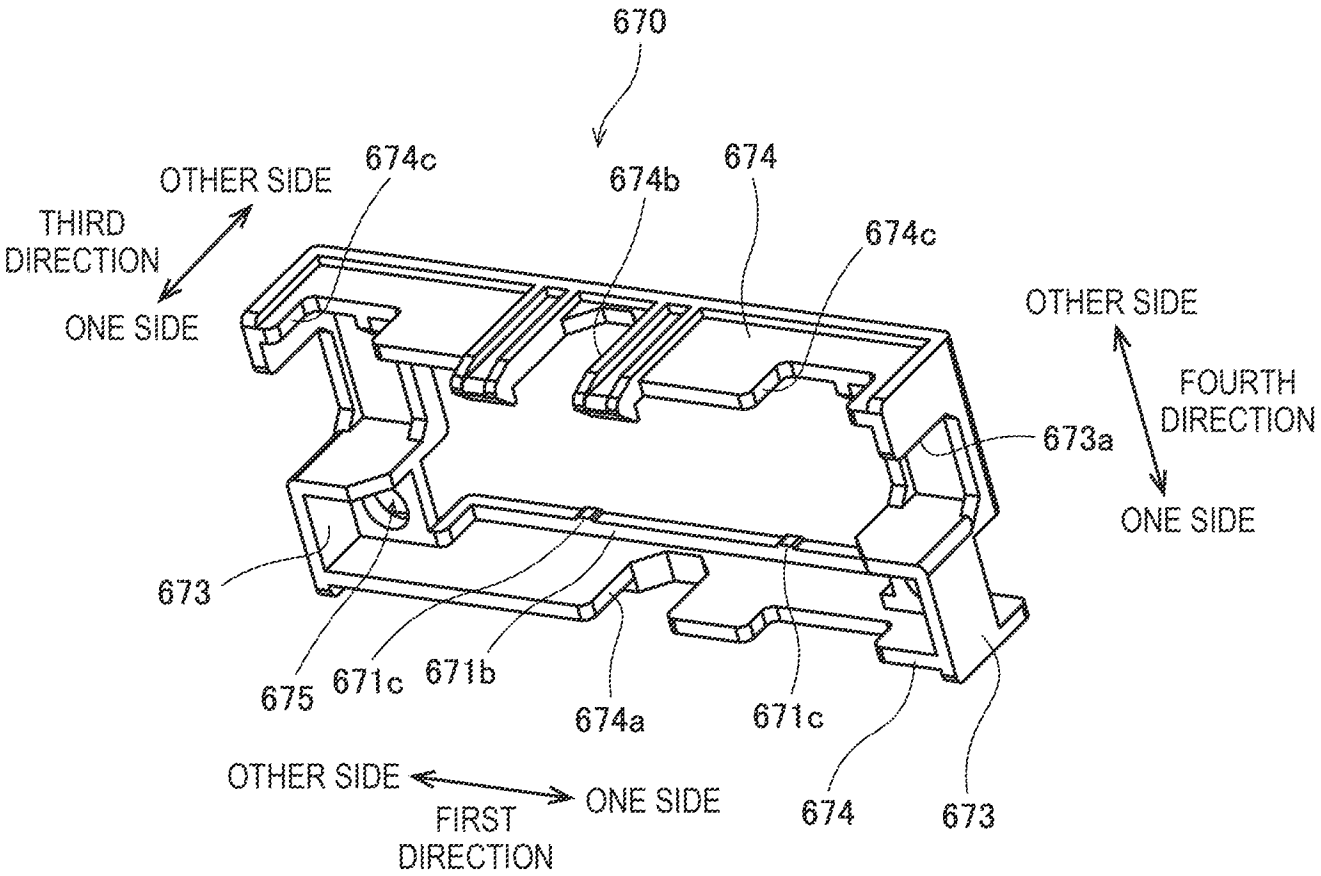
FIG. 9 is a perspective view of the cover.

Subsequently, a configuration of the cover 670 is described with reference to FIGS. 8 and 9. FIG. 8 is a perspective view of the cover 670 and screws 698. FIG. 9 is a perspective view of the cover 670, as seen in a direction different from FIG. 8.

The cover 670 has a rectangular frame shape, as seen in the third direction. The cover 670 has a frame part 671, a pair of first sidewalls 673, and a pair of second sidewalls 674. The frame part 671 has a rectangular outer shape, and is formed at its central part with a through-hole 671*a*. An inner peripheral surface of the through-hole 671*a* has a rectangular shape having long sides and short sides conforming to the outer shape of the frame part 671.

The pair of first sidewalls 673 is spaced in the first direction. The first sidewall 673 has a plate shape perpendicular to the first direction. The first sidewall 673 extends from a short side part of an outer edge of the frame part 671 toward one side in the third direction. The pair of second sidewalls 674 is spaced in the fourth direction. The second sidewall 674 has a plate shape perpendicular to the fourth direction. The second sidewall 674 extends from a long side part of the outer edge of the frame part 671 toward one side in the third direction.

The frame part 671 has a pair of through-holes 675. The through-hole 675 is formed to penetrate the frame part 671 in the third direction. As described later, the cover 670 is fixed to the base 660 with being overlapped in the third direction. The through-holes 675 are provided in positions corresponding to the screw holes 664 of the base 660. In the through-hole 675, a shaft part of the screw 698 can be inserted. When the frame part 671 is seen from the other side in the third direction, a region in which the through-hole 675 of the frame part 671 is formed is more recessed than the other region toward the other side in the third direction.

A second sidewall 674, which is located at one side in the fourth direction, of the pair of second sidewalls 674 has a first notch 674*a* opening toward one side in the third direction. The first notch 674*a* is provided at a central portion in the first direction of the second sidewall 674 located at one side in the fourth direction. A width of the first notch 674*a* in the first direction gradually decreases toward the other side in the third direction. That is, the width of the first notch 674*a* in the first direction decreases away from the base 660 in the third direction.

In the present illustrative embodiment, a second sidewall 674, which is located at the other side in the fourth direction, of the pair of second sidewalls 674 has a notch 674*b* opening toward one side in the third direction. When seen in the fourth direction, the notch 674*b* is provided with being overlapped with the first notch 674*a*. Also, the second sidewall 674 has second notches 674*c* provided in positions at both sides in the first direction away from a position (a position of the notch 674*b*) facing the first notch 674*a*. When seen in the fourth direction, the second notches 674*c* are provided in a pair with the notch 674*b* being interposed therebetween. The second notch 674*c* opens toward one side in the third direction. The second notch 674*c* has a rectangular shape, as seen in the fourth direction.

When seen in the third direction, the first notch 674*a* and the pair of second notches 674*c* are respectively arranged at apexes of a virtual isosceles triangle.

The first sidewalls 673 have third notches 673*a* opening toward one side in the third direction. The third notches 673*a* are provided in a pair on the first sidewalls 673 facing each other. The third notch 673*a* has a rectangular shape, as seen in the first direction.

Specifically, the frame part 671 of the cover 670 includes a flat surface 671*b*, and protrusions 671*c*. The flat surface 671*b* has a rectangular shape extending from end portions of the second sidewalls 674 at an opposite side (other side) to the base 660 in the third direction toward an inside of the cover 670 in the fourth direction. The protrusions 671*c* partially protrude from an inner edge of the flat surface 671*b* toward the inside of the cover 670 in the fourth direction. When seen in the third direction, the protrusions 671*c* are provided at four places on both sides in the first direction with the notches 674*a* and 674*b* being interposed therebetween. The four the protrusions 671*c* are respectively arranged at apexes of a virtual rectangle, as seen in the third direction.

<1-4-3. Configuration of Panel>

Figure 10:
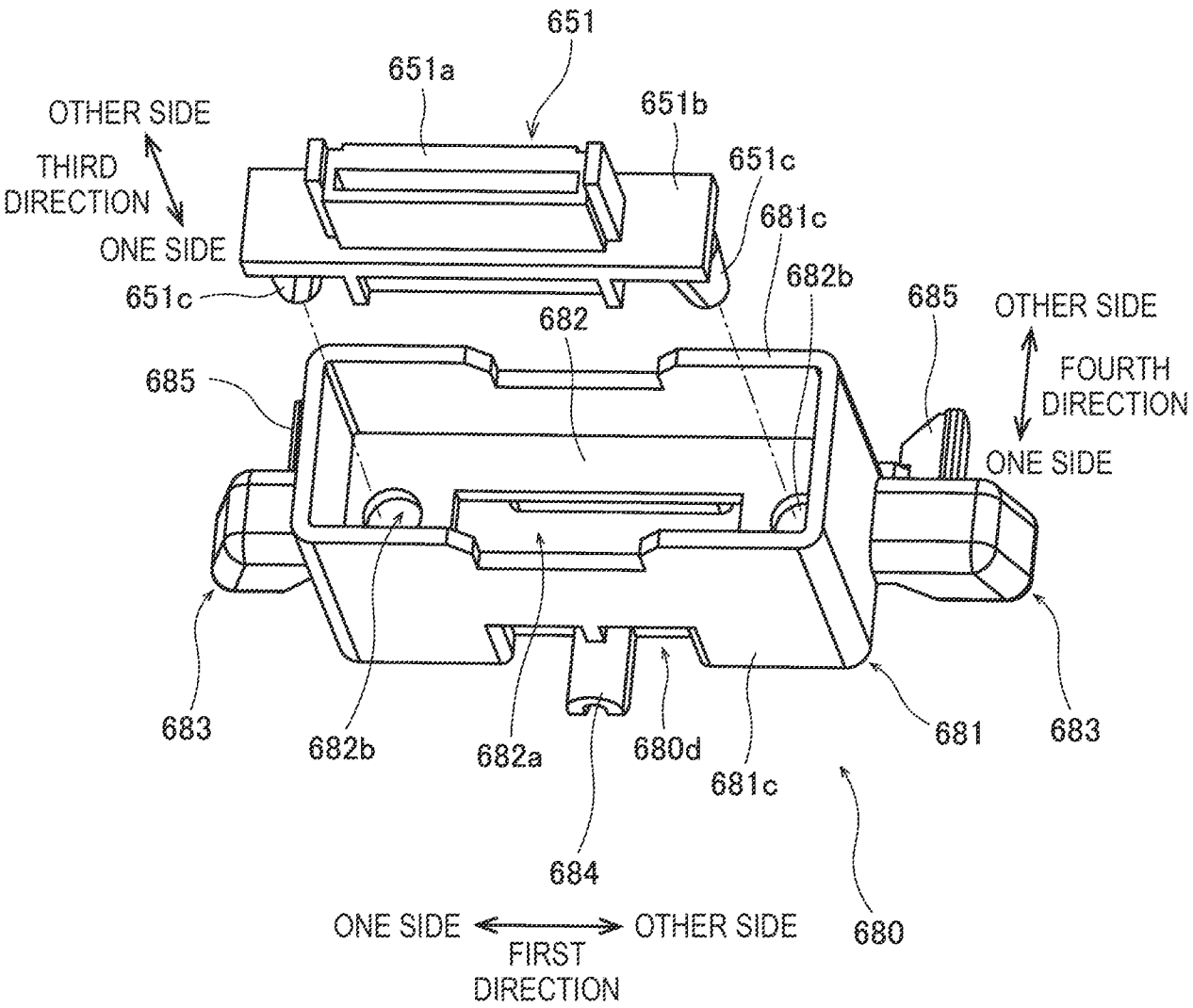
FIG. 10 is an exploded perspective view of a panel and a main body-side electrical contact part.
Figure 11:
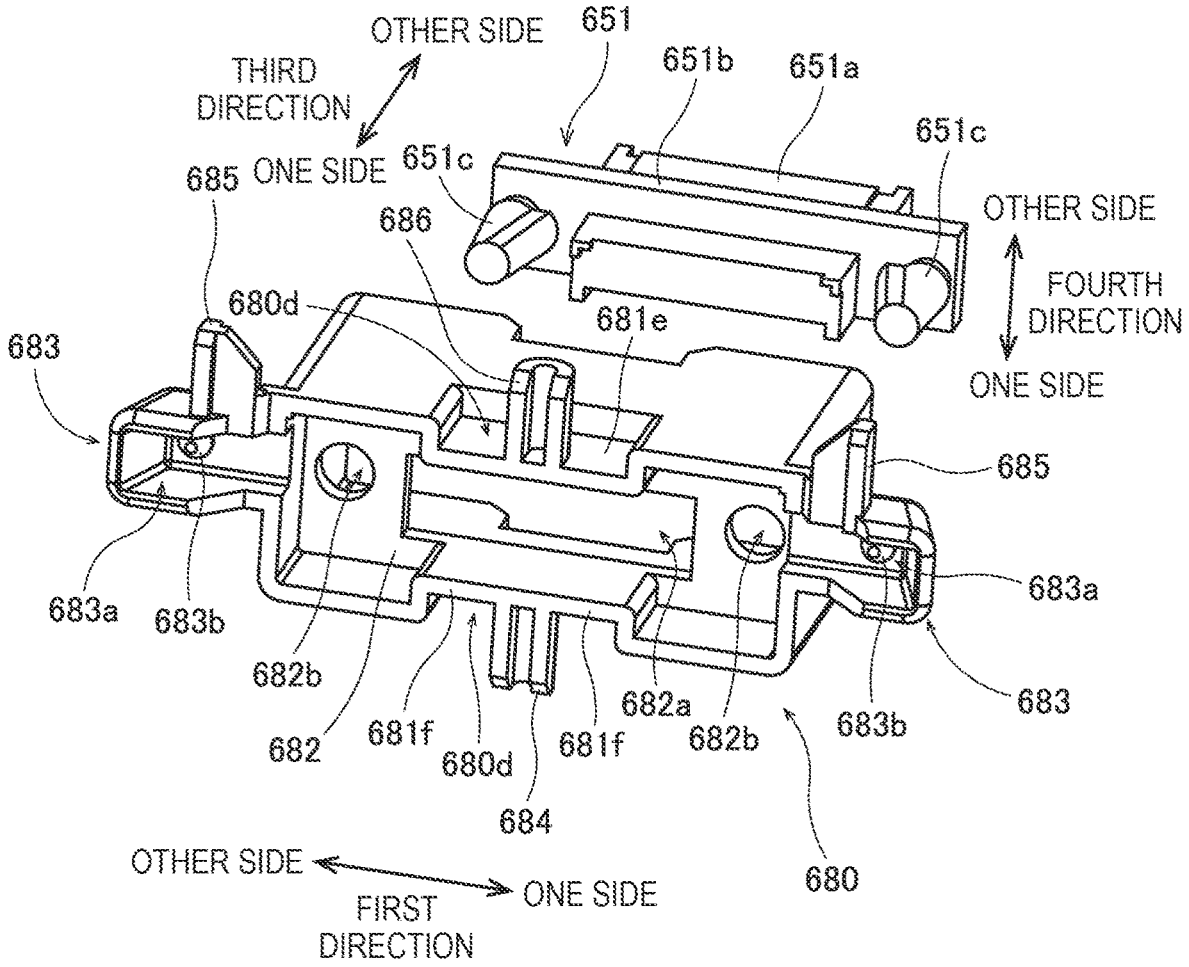
FIG. 11 is an exploded perspective view of the panel and the main body-side electrical contact part.

Subsequently, a configuration of the panel 680 is described with reference to FIGS. 10 and 11. FIG. 10 is a perspective view of the panel 680 and the main body-side electrical contact part 651. FIG. 11 is a perspective view of the panel 680 and the main body-side electrical contact part 651, as seen in a direction different from FIG. 10.

The panel 680 includes a box body 681, and a partitioning plate 682. The box body 681 has a square tube shape, and extends in the third direction. The box body 681 has a substantially rectangular outer shape, as seen in the third direction. The partitioning plate 682 has a rectangular plate shape perpendicular to the third direction. The partitioning plate 682 extends from an inner surface of a part of the box body 681 in the third direction toward an inside of the box body 681. The partitioning plate 682 is formed at a central part with a rectangular through-hole 682*a* conforming to the outer shape of the partitioning plate 682.

Through-holes (attachment part) 682*b* are arranged at both sides of the partitioning plate 682 in the first direction with the through-hole 682*a* being interposed therebetween. An inner peripheral surface of the through-hole 682*b* has a circular shape, as seen in the third direction. The main body-side electrical contact part 651 is attached into the through-holes 682*b* from the other side in the third direction.

The panel 680 has a pair of ear parts 683 extending outside of the panel 680 from both sides of the box body 681 in the first direction. The ear parts 683 are arranged at both sides in the first direction with the through-hole 682*a* and the through-holes 682*b* being interposed therebetween.

As shown in FIG. 11, the ear part 683 has therein a void. In other words, the ear part 683 has a concave portion 683*a* opening toward the base 660. The ear part 683 has a second spring seat 683*b* at a bottom of the concave portion 683*a*. That is, the second spring seat 683*b* is provided inside of the concave portion 683*a*. The spring seat 683*b* is connected with the other end of the coil spring 690 in the third direction.

End portions, which are located at one side in the third direction, of a pair of sidewalls 681*c*, which are perpendicular to the fourth direction, of sidewalls of the box body 681 have a concave portion 680*d*, respectively. The concave portion 680*d* is recessed from the sidewall 681*c* toward a radially inward side of the box body 681. A bottom of the concave portion 680*d* is configured as a flat surface portion 681*e* perpendicular to the fourth direction. An end face of the flat surface portion 681*e* on one side in the third direction continues to an end face of the box body 681 on one side in the third direction. The end face of the flat surface portion 681*e* at one side in the third direction is configured as a second contact surface 681*f* As described later, the second contact surface 681*f* can contact the first contact surface 663 of the base 660.

Also, the box body 681 has a first protrusion 684, a pair of second protrusions 685, and a third protrusion 686. The first protrusion 684 extends from the concave portion 680*d*, which is located at one side in the fourth direction, of the pair of concave portions 680*d* toward an outside of the box body 681. That is, the first protrusion 684 extends toward one side in the fourth direction. The second protrusions 685 extend from the pair of ear parts 683 toward the other side in the fourth direction, respectively. Also, the third protrusion 686 extends from the concave portion 680*d*, which is located at the other side in the fourth direction, of the pair of concave portions 680*d* toward an outside of the box body 681. That is, the third protrusion 686 extends toward the other side in the fourth direction.

The first protrusion 684 and the third protrusion 686 have a semicircular section, when taken along a section perpendicular to the fourth direction, respectively. The semicircular section has an open end directed to one side in the third direction. That is, outer surfaces of the first protrusion 684 and the third protrusion 686 have a semicircular shape of which a width in the first direction gradually decreases toward the other side in the third direction, as seen in the fourth direction.

<1-4-4. Configuration of Elastic Member>

The coil spring 690 is an elastic member of which a metal line is wound in a spiral shape. The coil spring 690 is interposed between the base 660 and the panel 680. The coil spring 690 is extendable and contractable in the third direction. Also, the coil spring 690 is bendable in a radial direction of the spiral. As described later, the coil spring 690 is arranged between the first spring seat 661 of the base 660 and the second spring seat 683*b* of the ear part 683 of the panel 680 in a state in which it is compressed more than a natural length.

<1-5. Configuration of Main Body-Side Electrical Contact Part>

In the below, a configuration of the main body-side electrical contact part 651 is described with reference to FIGS. 10 and 11. The main body-side electrical contact part 651 has a female connector terminal 651*a*, a connector terminal support 651*b*, and a pair of shaft parts 651*c*.

The female connector terminal 651*a* is arranged therein with the plurality of electric contact points. The connector terminal support 651*b* is a rectangular plate-shaped part perpendicular to the third direction. The female connector terminal 651*a* is fixed to a central part of the connector terminal support 651*b*. The pair of shaft parts 651*c* is positioned on an end face of the connector terminal support 651*b* on one side in the third direction. The shaft parts 651*c* are arranged at both sides in the first direction with the female connector terminal 651*a* being interposed therebetween.

The shaft part 651*c* has a conical shape, and protrudes from the connector terminal support 651*b* toward one side in the third direction. The shaft part 651*c* is formed of an elastic material. The shaft part 651*c* can be contracted radially as a result of operator's pressing.

<1-6. Attachment Configuration of Respective Parts of Main Body-Side Connector>

Figure 12:
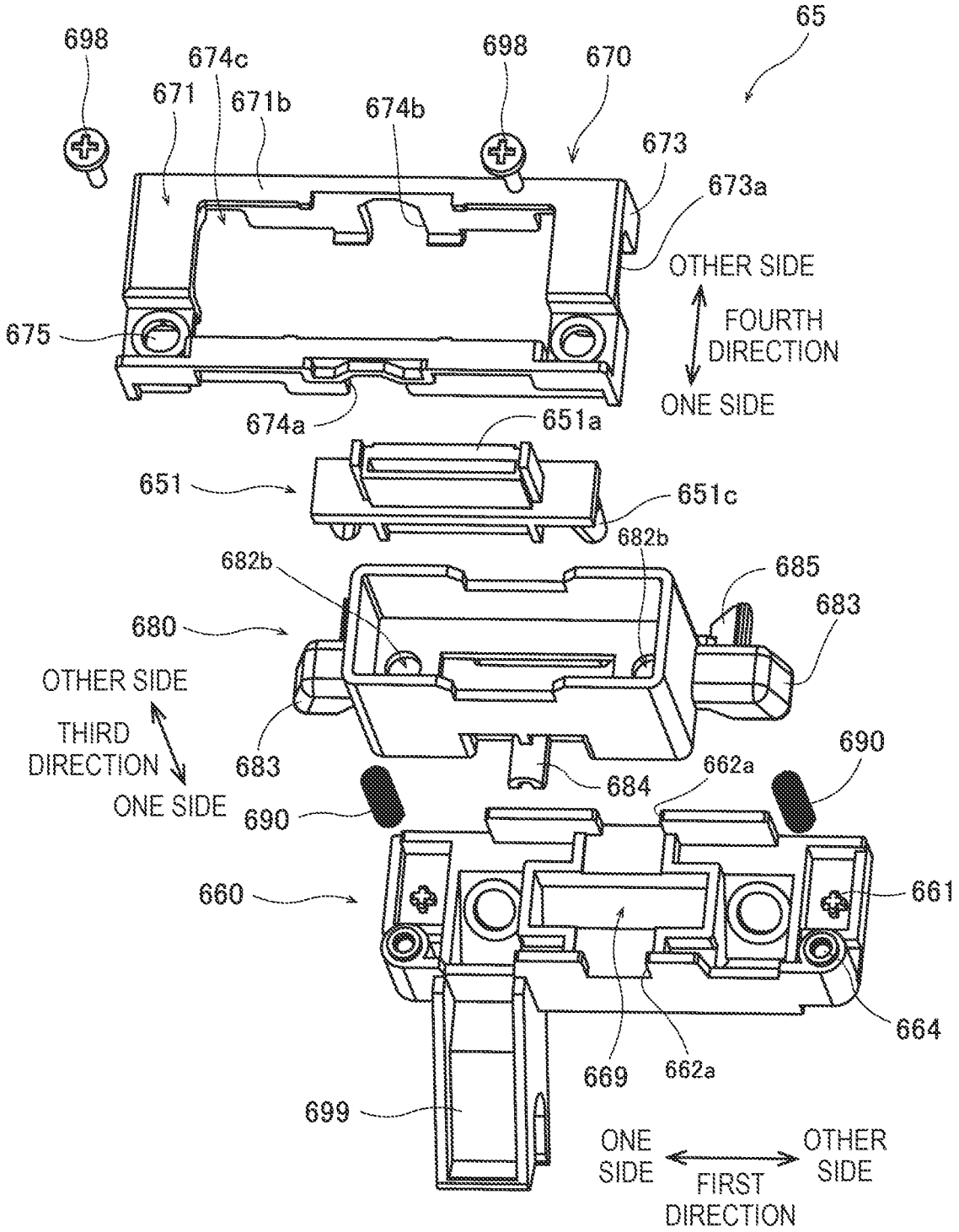
FIG. 12 is an exploded perspective view of the main body-side connector.
Figure 13:
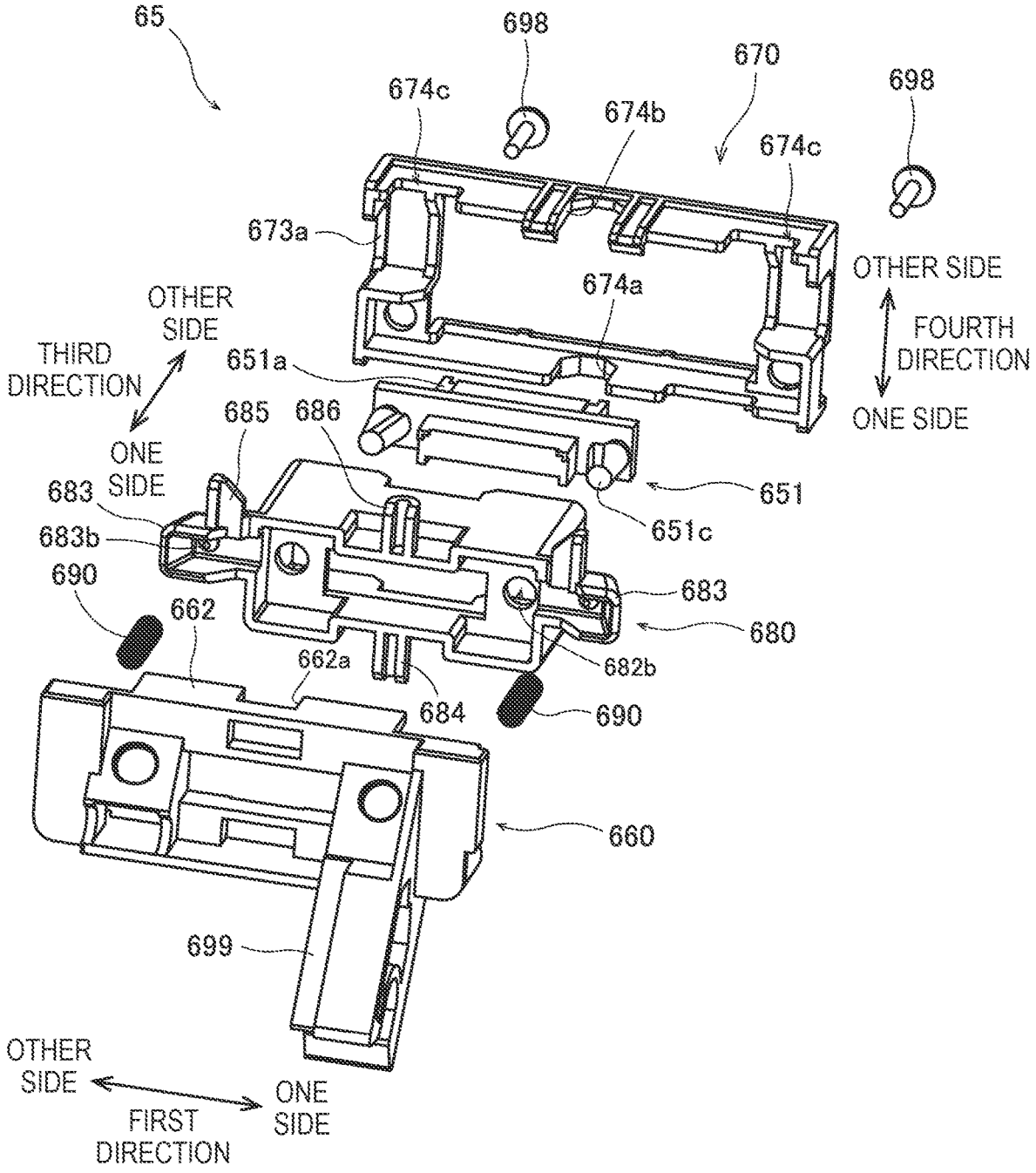
FIG. 13 is an exploded perspective view of the main body-side connector.

In the below, an attachment aspect of the base 660, the cover 670, the panel 680, the coil springs 690, the screws 698, and the main body-side electrical contact part 651 is described with reference to FIGS. 12 and 13. FIG. 12 is an exploded perspective view of the main body-side connector 65. FIG. 13 is an exploded perspective view of the main body-side connector 65, as seen in a direction different from FIG. 12.

First, an operator in a factory for manufacturing the image forming apparatus 100 inserts the shaft parts 651*c* of the main body-side electrical contact part 651 into the through-holes 682*b* of the partitioning plate 682 of the panel 680 while pressing the shaft parts 651*c*. Thereby, the main body-side electrical contact part 651 is attached to the panel 680. The shaft parts 651*c* expand radially outward after passing through the through-holes 682*b*. Thereby, the main body-side electrical contact part 651 cannot be separated from the partitioning plate 682 of the panel 680.

The panel 680 having the main body-side electrical contact part 651 attached thereto is partially sandwiched between the base 660 and the cover 670. Specifically, one ends of the pair of coil springs 690 are respectively attached to the first spring seats 661 of the base 660. In this state, the panel 680 is overlapped over the base 660 from the other side in the third direction. At this time, the other ends of the coil springs 690 are attached to the second spring seats 683*b* of the ear parts 683 of the panel 680. Also, the first protrusion 684 of the panel 680 is accommodated in the notch 662*a* of the base 660 on one side in the fourth direction. Also, the pair of second protrusions 685 of the panel 680 is arranged on both sides of the end wall 662 in the first direction while sandwiching the end wall 662 on the other side in the fourth direction therebetween. The third protrusion 686 of the panel 680 is accommodated in the notch 662*a* of the base 660 on the other side in the fourth direction.

As shown in FIGS. 12 and 13, the cover 670 is further overlapped over the base 660 having the panel 680 overlapped thereon, from the other side in the third direction. At this time, the first protrusion 684 of the panel 680 is accommodated in the first notch 674*a* of the cover 670. The pair of second protrusions 685 of the panel 680 is accommodated in the second notches 674*c* of the cover 670. The third protrusion 686 of the panel 680 is accommodated in the notch 674*b* of the cover 670. The pair of ear parts 683 of the panel 680 is accommodated in the pair of third notches 673*a* of the cover 670. In this state, the shaft parts of the screws 698 are inserted into the through-holes 675 of the cover 670 from the other side in the third direction, and are screwed into the screw holes 664 of the base 660. Thereby, the cover 670 is fixed to the base 660 while sandwiching the coil springs 690 and the panel 680 therebetween.

<1-7. Movement of Connector>

Figure 14:
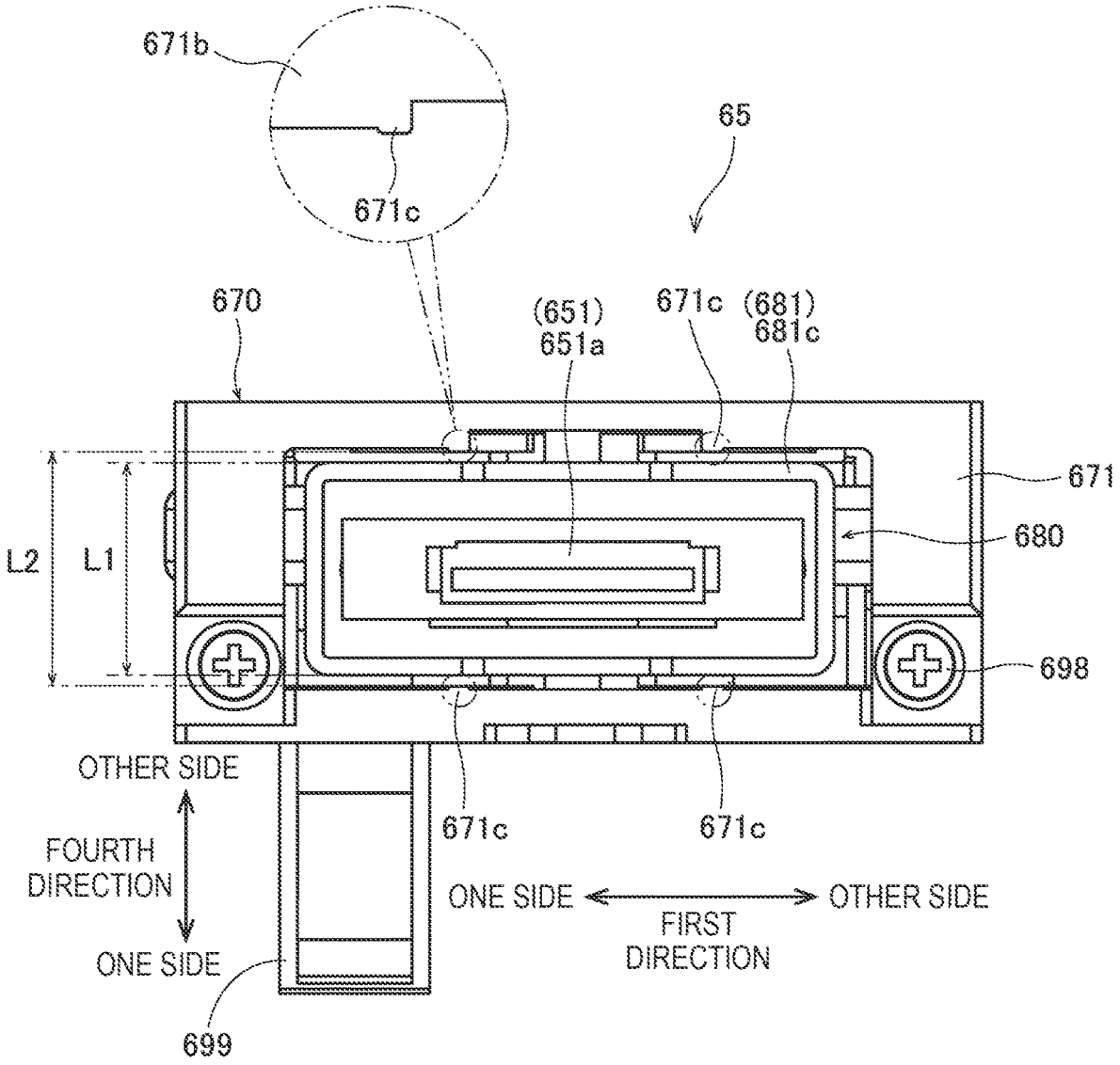
FIG. 14 depicts the main body-side connector, as seen from the other side in a third direction.
Figure 15:
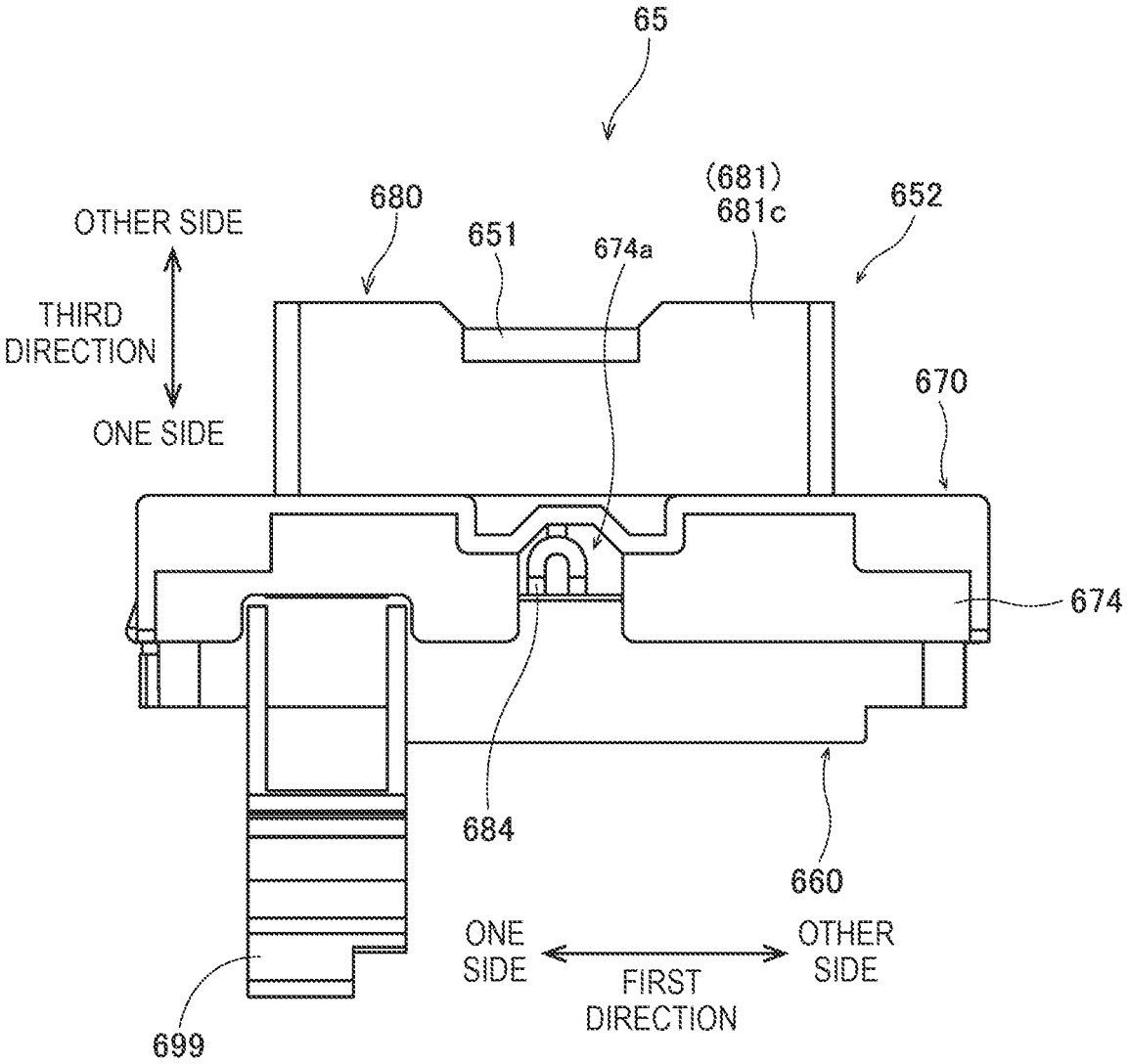
FIG. 15 depicts the main body-side connector, as seen from one side in a fourth direction.
Figure 16:
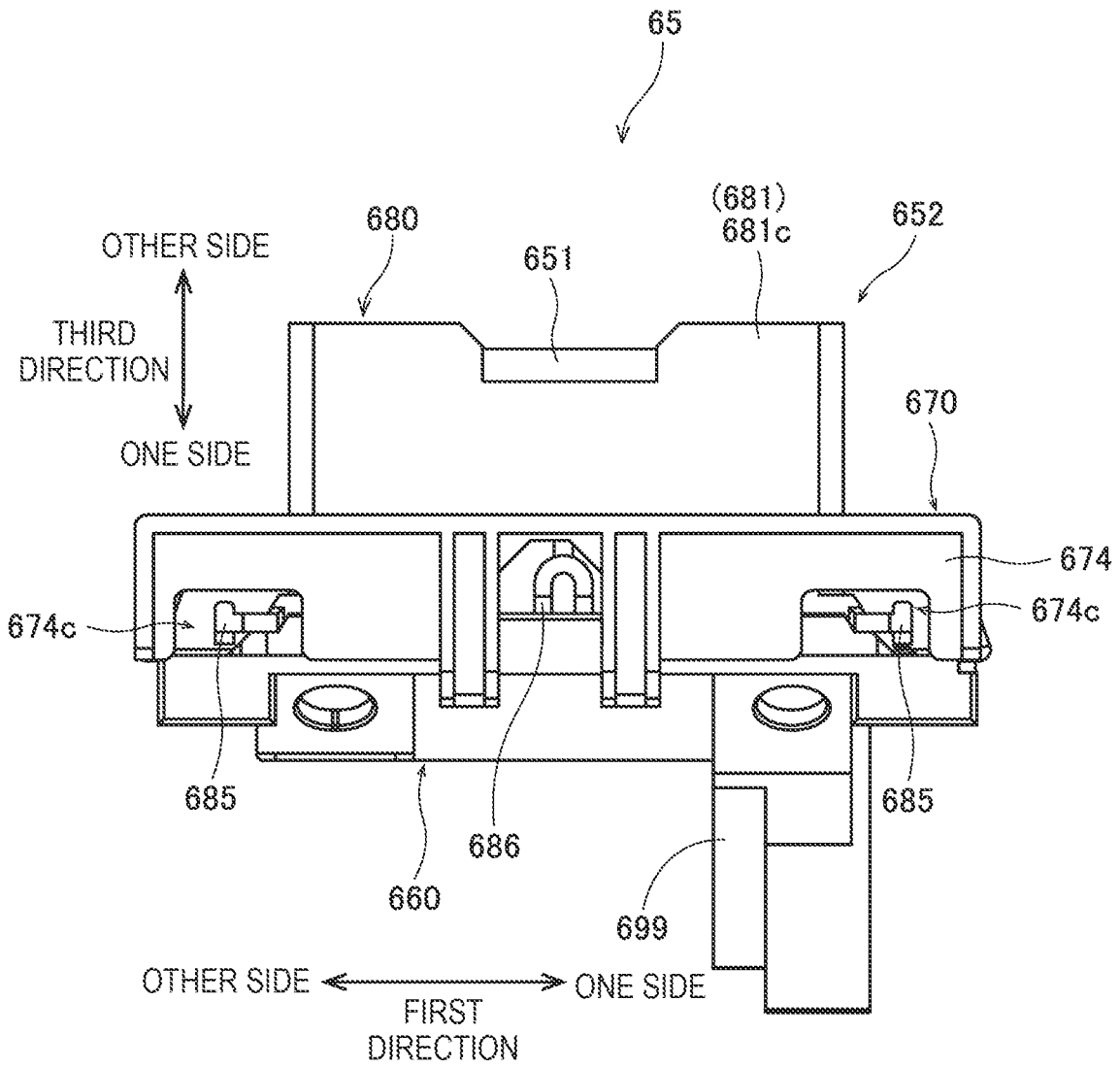
FIG. 16 depicts the main body-side connector, as seen from the other side in the fourth direction.
Figure 17:
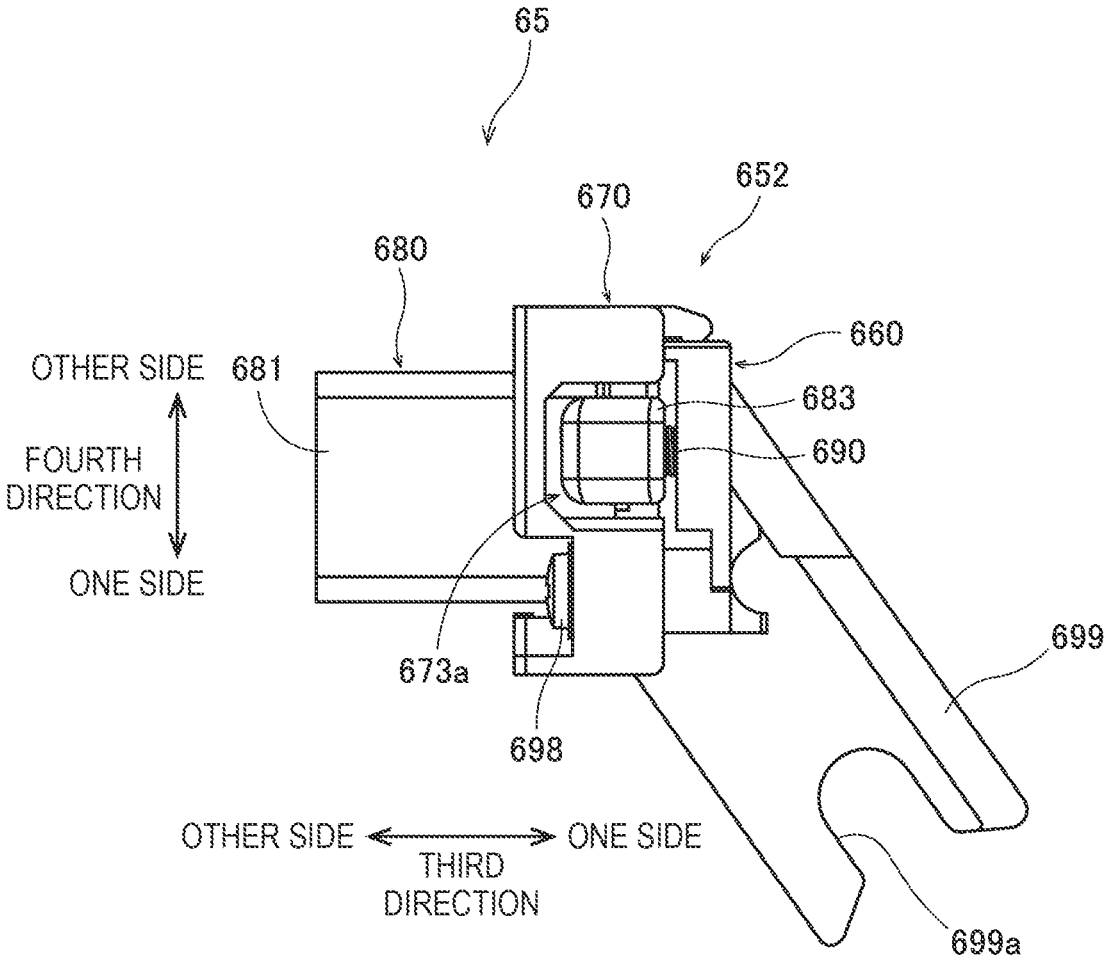
FIG. 17 depicts the main body-side connector, as seen from the other side in a first direction.
Figure 18:
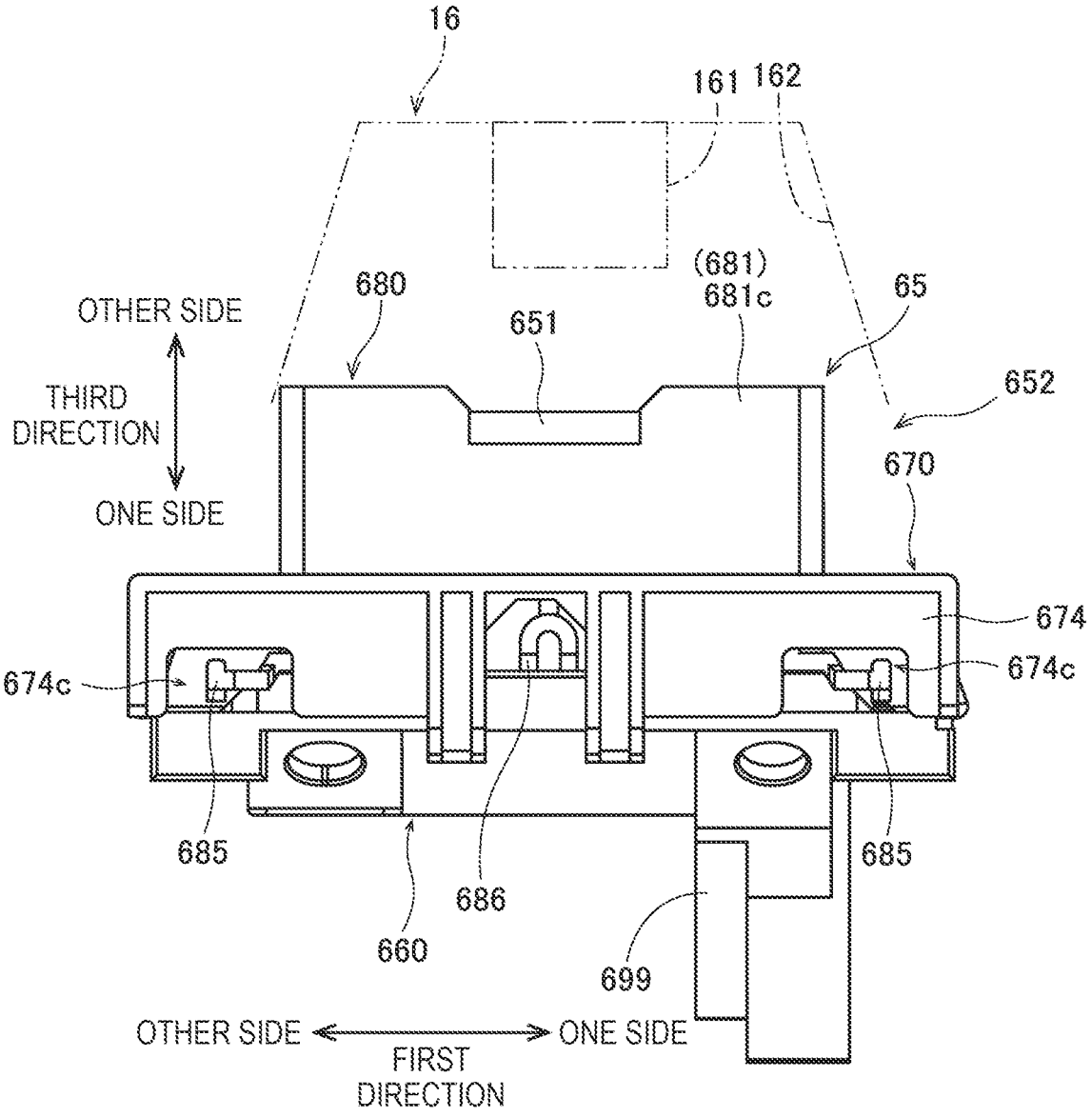
FIG. 18 is a pictorial view depicting an aspect in which the socket is in contact with a part of the holder.

In the below, movement of the main body-side connector 65 attached as described above is described with reference to FIGS. 14 to 18. FIG. 14 depicts the main body-side connector 65, as seen from the other side in the third direction. FIG. 15 depicts the main body-side connector 65, as seen from one side in the fourth direction. FIG. 16 depicts the main body-side connector 65, as seen from the other side in the fourth direction. FIG. 17 depicts the main body-side connector 65, as seen from the other side in the first direction. FIG. 18 depicts an aspect in which the socket 162 is in contact with a part of the holder 652.

In the main body-side connector 65, the coil springs 690 are held compressed more than a natural length between the base 660 and the panel 680. Therefore, the main body-side electrical contact part 651 is always compressed toward the other side in the third direction. However, the first protrusion 684 is moved only within a range surrounded by the notch 662*a* and the first notch 674*a*, and the second protrusions 685 are moved only within a range surrounded by the second notches 674*c*, so that a position of the main body-side electrical contact part 651 in the third direction is constant in a state in which it is not in contact with the drawer-side electrical contact part 161.

However, the coil springs 690 are held in a state in which there is an allowance for contraction toward one side in the third direction. For this reason, as shown in FIG. 18, when the main body-side connector 65 is applied with external force as a result of contact of the panel 680 (the box body 681) to the socket 162, for example, the coil springs 690 are deformed and the position of the main body-side electrical contact part 651 can be thus correspondingly displaceable in the third direction, and in the direction perpendicular to the third direction. That is, the main body-side electrical contact part 651 is floated with respect to a part (the base 660 and the cover 670) of the holder 652.

Also, as shown in FIG. 15, in the main body-side connector 65, a gap is formed in the first direction between an outer surface of the first protrusion 684 and an inner surface of the first notch 674*a*. Also, as shown in FIG. 16, a gap is formed in the first direction between an outer surface of the second protrusion 685 and an inner surface of the second notch 674*c*. Therefore, even when the main body-side connector 65 is applied with the external force as a result of contact of the panel 680 (the box body 681) to the socket 162, for example, the first protrusion 684 is moved only within the first notch 674*a* and the second protrusion 685 is moved only within the second notch 674*c*, so that a movement range of the main body-side electrical contact part 651 in the first direction is restrained.

Also, as shown in FIG. 14, in the main body-side connector 65, a spacing distance L2 between the protrusions 671*c* facing each other in the fourth direction is greater than a distance L1 between the outer surfaces of the sidewalls 681*c*, which face each other in the fourth direction, of the panel 680 (L1<L2). In other words, a gap is formed in the fourth direction between an outer surface of the box body 681 of the panel 680 and an inner edge surface of the protrusion 671*c*. Therefore, even when the main body-side connector 65 is applied with the external force as a result of contact of the panel 680 to the socket 162, for example, the outer surface of the sidewall 681*c* of the panel 680 is moved only to a position in which it contacts any one of the protrusions 671*c* facing in the fourth direction, so that the movement range of the main body-side electrical contact part 651 in the fourth direction is restrained.

Also, as shown in FIG. 17, the ear part 683 extends in the first direction through the third notch 673*a*. Thereby, the panel 680 is pressed by the coil springs 690 in outermore positions of the base 660 and the panel 680 in the first direction. As a result, a posture of the main body-side electrical contact part 651 is further stabilized.

Also, in the main body-side connector 65, even if the coil springs 690 are compressed by the entire allowance due to a shock upon the contact of the drawer-side electrical contact part 161 to the main body-side electrical contact part 651, for example, the first contact surface 663 of the base 660 and the second contact surface 681*f* of the box body 681 of the panel 680 are contacted to each other. In other words, the main body-side connector 65 is bottomed. In this way, the main body-side connector 65 is configured to be elastically deformable in the third direction, so that excessive load is prevented from being applied to the coil springs 690 and the like.

As described above, the image forming apparatus 100 of the present illustrative embodiment includes the drawer 10, and the image forming apparatus main body 60. The drawer 10 includes the photosensitive drums 11, the frame 12, the drum memory 13 and the toner memory 15, and the drawer-side connector 16. The drawer-side connector 16 is located on one outer surface of the frame 12 in the second direction. The drawer-side connector 16 includes the drawer-side electrical contact part 161 and the socket 162. The image forming apparatus main body 60 includes the housing 61, the controller 64, and the main body-side connector 65. The main body-side connector 65 includes the main body-side electrical contact part 651, and the holder 652. The holder 652 includes the base 660, the cover 670, the panel 680, and the coil spring (elastic member) 690. The housing 61 includes the internal space 610 in which the drawer 10 can be accommodated by moving the same relative to the housing 61 in the insertion direction. The main body-side electrical contact part 651 is in contact with the drawer-side electrical contact part 161 when the drawer 10 is inserted in the housing 61. The main body-side electrical contact part 651 is fixed to the panel 680. The coil spring 290 is interposed between the base 660 and the panel 680. The holder 652 is configured to hold the main body-side electrical contact part 651 so as to be movable in the intersection direction intersecting with the extension and contraction direction of the coil spring. In the image forming apparatus 100, when the holder 652 is in contact with the socket 162 of the drawer-side connector 16, the panel 680 is moved relative to the base 660 in the intersection direction, together with the main body-side electrical contact part 651. As a result, the main body-side electrical contact part 651 and the drawer-side electrical contact part 161 are easily contacted to each other. Specifically, even when there is an error in the positional relation between the drawer-side electrical contact part 161 and the main body-side electrical contact part 651 after a part of the holder 652 of the main body-side starts to contact the socket 162 of the drawer-side connector 16, the main body-side electrical contact part 651 is moved relative to the base 660 in the intersection direction by using the external force applied upon the insertion, together with the panel 680. Thereby, the main body-side electrical contact part 651 is guided into the socket 162 of the drawer-side connector 16, so that the drawer-side connector 16 and the main body-side connector 65 can be easily interconnected.

Also, in the image forming apparatus 100 of the present illustrative embodiment, the holder 652 is configured to hold the main body-side electrical contact part 651 to be movable in the third direction. Thereby, the holder 652 functions as a damper, so that it is possible to suppress high load from being applied to the electrical contact parts 651 and 161, the holders (sockets) 652 and 162 configured to accommodate the same, and the like.

Also, in the image forming apparatus 100 of the present illustrative embodiment, the holder 652 is configured to press the main body-side electrical contact part 651 toward one side in the third direction. Thereby, the holder 652 is moved in the third direction, so that it is possible to suppress high load from being applied to the main body-side electrical contact part 651, the holder 652 configured to accommodate the same, and the like.

Also, in the image forming apparatus 100 of the present illustrative embodiment, the holder 652 is configured to press the main body-side electrical contact part 651 by using the coil springs 690. Thereby, it is possible to easily move the main body-side electrical contact part 651 in the third direction and in the intersection direction, due to characteristics of the coil springs 690.

Also, in the image forming apparatus 100 of the present illustrative embodiment, the coil springs 690 press the main body-side electrical contact part 651 in two positions of one side and the other side in the first direction while interposing the main body-side electrical contact part 651 therebetween. Thereby, as compared to a configuration in which the coil spring 690 is one, the posture of the main body-side electrical contact part 651 can be further stabilized.

Also, in the image forming apparatus 100 of the present illustrative embodiment, the holder 652 includes the base 660, the cover 670, and the panel 680. The base 660 has the first contact surface 663, and the first spring seat 661. The panel 680 has the through-hole (attachment part) 682*b*, the second contact surface 681*f*, and the second spring seat 683*b*. In the image forming apparatus 100, the holder 652 is configured to restrain the movement range of the panel 680 relative to the base 660 and the cover 670. Thereby, while the main body-side electrical contact part 651 is enabled to be movable in the third direction and the direction intersecting with the third direction, the movement range of the main body-side electrical contact part 651 can be restrained. As a result, it is possible to more easily approach and interconnect the drawer-side electrical contact part 161 and the main body-side electrical contact part 651.

Also, in the image forming apparatus 100 of the present illustrative embodiment, the cover 670 has the pair of first sidewalls 673, and the pair of second sidewalls 674. One of the pair of second sidewalls 674 has the first notch 674*a*. The panel 680 has the first protrusion 684. In the image forming apparatus 100, the first protrusion 684 is accommodated in the first notch 674*a*, and the gap is formed in the first direction between the outer peripheral surface of the first protrusion 684 and the inner surface of the first notch 674*a*. Thereby, the first protrusion 684 is moved only within the first notch 674*a*, so that the movement range of the main body-side electrical contact part 651 in the first direction can be restrained.

Also, in the image forming apparatus 100 of the present illustrative embodiment, the other of the pair of second sidewalls 674 has the second notches 674*c*. The panel 680 has the second protrusions 685. The second protrusions 685 are accommodated in the second notches 674*c*. Thereby, the first protrusion 684 is moved only within the first notch 674*a* and the second protrusions 685 is moved only within the second notches 674*c*, so that the movement range of the main body-side electrical contact part 651 in the third direction can be restrained. The movement range of the main body-side electrical contact part 651 in the third direction is restrained at a total of three places of one place of the first notch 674*a* and two places of the second notches 674*c*, so that it is possible to suppress a situation in which the main body-side electrical contact part 651 (panel 680) is applied with excessive load and is not thus moved.

Also, in the image forming apparatus 100 of the present illustrative embodiment, when seen in the third direction, the first notch 674*a* and the two second notches 674*c* are respectively arranged at apexes of an isosceles triangle. Thereby, the excessive load is hardly applied to the main body-side electrical contact part 651 (panel 680), so that smoother movement can be implemented.

Also, in the image forming apparatus 100 of the present illustrative embodiment, the width of the first notch 674*a* in the first direction gradually decreases away from the base 660 in the third direction. Thereby, while the panel 680 protrudes relative to the base 660 in the third direction according to the pressing force, the first protrusion 684 can move only relatively small in the first direction. However, while the panel 680 contracts (approaches the base 660) in the third direction against the pressing force, the first protrusion 684 can move relatively large in the first direction. Therefore, it is possible to increase an allowable range of movement of the first protrusion 684 in the first direction only when the main body-side electrical contact part 651 and the drawer-side electrical contact part 161 are in contact with each other. In other words, in other cases, it is possible to arrange the main body-side electrical contact part 651 in a fixed position with accuracy. As a result, the main body-side connector 65 and the drawer-side connector 16 can be connected with accuracy.

Also, in the image forming apparatus 100 of the present illustrative embodiment, the cover 670 has the flat surface 671*b*, and the protrusions 671*c*. In the image forming apparatus 100, the main body-side electrical contact part 651 and the panel 680 are moved in the fourth direction, so that the protrusions 671*c* can be partially contacted to the outer surface of the panel 680 in the fourth direction. Thereby, the panel 680 is moved in the fourth direction only to the position in which it contacts the protrusions 671*c*, so that the movement range of the main body-side electrical contact part 651 in the fourth direction can be restrained.

Also, in the image forming apparatus 100 of the present illustrative embodiment, the panel 680 has the ear parts 683. The ear part 683 has the concave portion 683*a*. Also, the second spring seat 683*b* is provided in the concave portion 683*a*. Thereby, the coil spring 690 can be arranged in the internal space of the ear part 683. Therefore, the panel 680 can be pressed in outermore positions of the base 660 and the panel 680 in the first direction. Thereby, it is possible to further stabilize the posture of the main body-side electrical contact part 651.

Also, in the image forming apparatus 100 of the present illustrative embodiment, the pair of first sidewalls 673 has the third notches 673*a*. The ear part 683 extends in the first direction through the third notch 673*a* (refer to FIG. 17). Thereby, the panel 680 can be pressed in outermore positions of the base 660 and the panel 680 in the first direction. Thereby, it is possible to further stabilize the posture of the main body-side electrical contact part 651.

Although the favorable illustrative embodiment of the present disclosure has been described, the present disclosure is not limited thereto, and a variety of changes can be made to the above illustrative embodiment.

<2. Modification to Illustrative Embodiments>

In the illustrative embodiment, the developing cartridges 14 of respective colors are inserted to the drawer 10 as the common drum cartridge. However, instead of this configuration, the drum cartridge and the developing cartridge form a pair, and the pair of cartridges of each color (process cartridge) may be individually inserted to the drawer.

In the above-described illustrative embodiment, the main body-side electrical contact part 651 of the main body-side connector 65 has the female connector terminal. Alternatively, the main body-side electrical contact part may have a male connector terminal. In this case, the drawer-side connector may have a female connector terminal.

In the above-described illustrative embodiment, the plurality of electrical contact surfaces is aligned at the drawer-side electrical contact part 161, and the plurality of corresponding electric contact points is aligned on the main body-side electrical contact part 651. However, the present disclosure is not limited thereto. For example, the plurality of electrical contact surfaces may be aligned on the main body-side electrical contact part 651, and the plurality of corresponding electric contact points may be aligned on the drawer-side electrical contact part 161.

In the image forming apparatus 100 of the above-described illustrative embodiment, the drum memory 13 and the toner memory 15 are provided as the drawer memory. However, the present disclosure is not limited thereto. For example, the drawer memory may have only the toner memory or only the drum memory.

The third protrusion 686 and the notch 674*b* for accommodating the same may be omitted.

In the illustrative embodiment, the elastic member is the coil spring 690. However, the present disclosure is not limited thereto. For example, as the elastic member, a plate spring, a sponge, a rubber material or the like may also be used.

In a state in which the external force is not applied to the main body-side connector 65, when seen in the fourth direction, the first protrusion 684 may be offset relative to a central position of the first notch 674*a* in the first direction.

As used herein, the term "storage" may include temporary storing of simply relaying information.

Also, the configuration and detailed shape of the image forming apparatus can be appropriately changed without departing from the gist of the present disclosure. Also, the respective elements disclosed in the illustrative embodiment and the modified illustrative embodiments can be appropriately combined with no inconsistency.

As discussed above, the disclosure may provide at least the following illustrative, non-limiting aspects.

(1) An image forming apparatus comprising: a drawer comprising: a frame configured to hold a plurality of photosensitive drums while spacing the plurality of photosensitive drums at intervals in a second direction, each of the plurality of the photosensitive drums being rotatable about an axis extending in a first direction; a drawer memory storing at least one of information about at least one of the plurality of photosensitive drums and information about developing cartridges removably insertable to the frame; and a drawer-side connector located at an outer surface of the frame on one side in the second direction, the drawer-side connector comprising: a drawer-side electrical contact part electrically connected to the drawer memory; and a socket configured to hold therein the drawer-side electrical contact part; and an image forming apparatus main body comprising: a housing having an internal space, the drawer being accommodated in the internal space by moving the drawer relative to the housing in an insertion direction; a controller; and a main body-side connector comprising: a main body-side electrical contact part electrically connected to the controller, the main body-side electrical contact part being contactable the drawer-side electrical contact part in case the drawer is inserted in the housing; and a holder comprising: a base; a panel, the main body-side electrical contact part being fixed to the panel; and an elastic member interposed between the base and the panel, the holder being configured to hold the main body-side electrical contact part to be movable in an intersection direction intersecting with an extension and contraction direction of the elastic member, wherein in a case the holder is in contact with the socket of the drawer-side connector, the panel moves relative to the base in the intersection direction together with the main body side-electrical contact part, and the main body side-electrical contact part and drawer-side electrical contact part are in contact with each other.

(2) The image forming apparatus of (1), wherein the holder is further configured to hold the main body-side electrical contact part to be movable in the third direction.

(3) The image forming apparatus of (2), wherein the intersection direction and the third direction are orthogonal to each other.

(4) The image forming apparatus of any one of (1) to (3), wherein the holder is configured to press the main body-side electrical contact part toward a first side in the third direction.

(5) The image forming apparatus of (4), wherein the holder is configured to press the main body-side electrical contact part by using a coil spring as the elastic member.

(6) The image forming apparatus of (5), wherein the coil springs are provided to interpose the main body-side electrical contact part therebetween and are configured to press the electrical contact part in two positions of a first side and a second side in the first direction.

(7) The image forming apparatus of any one of (1) to (6), wherein the holder comprises: a base comprising: a first contact surface that is a flat surface-shaped part perpendicular to the third direction; and a first spring seat, one end of the elastic member in the third direction being connected to the first spring seat; a cover fixed to the base with being overlapped in the third direction; and a panel comprising: an attachment part, the main body-side electrical contact part being attached to the attachment part; a second contact surface contactable the first contact surface; and a second spring seat, the other end of the elastic member in the third direction being connected to the second spring seat, and wherein the holder is configured to restrain a movement range of the panel relative to the base and the cover.

(8) The image forming apparatus of (7), wherein the cover comprises: a pair of first sidewalls facing each other in the first direction; and a pair of second sidewalls facing each other in a fourth direction, the fourth direction being perpendicular to the first direction and the third direction, wherein one of the pair of second sidewalls has a first notch opened on a side facing the base, wherein the panel has a first protrusion extending in the fourth direction, and wherein the first protrusion is accommodated in the first notch with a gap being formed in the first direction between an outer peripheral surface of the first protrusion and an inner surface of the first notch.

(9) The image forming apparatus of (8), wherein the other of the pair of second sidewalls of the cover has second notches located at both sides thereof at positions distant from a position facing the first notch in the first direction, each of the second notches being opened at a side facing the base, wherein the panel has second protrusions extending in the fourth direction, and wherein the second protrusions are respectively accommodated in the second notches.

(10) The image forming apparatus of (9), wherein when seen in the third direction, the first notch and the two second notches are respectively arranged at apexes of an isosceles triangle.

(11) The image forming apparatus of any one of (8) to (10), wherein a width of the first notch in the first direction gradually decreases away from the base in the third direction.

(12) The image forming apparatus of any one of (8) to (11), wherein the cover comprises: a flat surface extending in a rectangular shape toward an inner side of the cover from end portions of the pair of second sidewalls which are opposite to the base in the third direction; and a protrusion protruding from an inner edge of the flat surface toward the inner side of the cover in the fourth direction, and wherein movement of the main body-side electrical contact part and the panel in the fourth direction allowing a part of the protrusion to be in contact with an outer surface of the panel in the fourth direction.

(13) The image forming apparatus of any one of (8) to (12), wherein the panel comprises ear parts arranged at both sides thereof in the first direction with the attachment part being positioned therebetween, wherein each of the ear parts has a concave portion opened toward the base, and wherein the second spring seat is provided in the concave portion.

(14) The image forming apparatus of (13), wherein the pair of first sidewalls each has a third notch opened on a side facing the base, and wherein each of the ear parts extends in the first direction through the respective third notch.

(15) The image forming apparatus of any one of (1) to (14), wherein the developing cartridges for accommodating toners therein are removably insertable to the frame, wherein toner identification information identifying the developing cartridges and toner life-span information are stored in the drawer memory, and wherein the drawer-side connector and the main body-side connector are configured to be interconnected to relay communication between the drawer memory and the controller.

(16) The image forming apparatus of any one of (1) to (15), wherein drum identification information identifying the photosensitive drums and drum life-span information are stored in the drawer memory, and wherein the drawer-side connector and the main body-side connector are configured to be interconnected to relay communication between the drawer memory and the controller.

According to the aspects (1) to (16) of the present disclosure, the image forming apparatus capable of electrically connecting the storage medium on the drawer-side to the controller of the image forming apparatus main body with accuracy and ease via the electrical contact part on the drawer-side and the electrical contact part on the image forming apparatus main body-side is provided.

According to the aspect (1) of the present disclosure, even when there is an error in positional relation between the drawer-side electrical contact part and the main body-side electrical contact part after a part of the holder of the main body-side connector starts to contact the socket of the drawer-side connector, the main body-side electrical contact part moves in the intersection direction together with the part of the holder by using force upon insertion. Thereby, the main body-side electrical contact part is guided into the socket of the drawer-side connector, so that the drawer-side connector and the main body-side connector can be easily interconnected.

According to the aspect (2) of the present disclosure, the holder functions as a damper, so that it is possible to suppress high load from being applied to the electrical contact part, the holder configured to accommodate the same, and the like.

According to the aspect (4) of the present disclosure, the holder moves in the third direction, so that it is possible to suppress high load from being applied to the main body-side electrical contact part, the holder configured to accommodate the same, and the like.

According to the aspect (5) of the present disclosure, it is possible to easily move the main body-side electrical contact part in the third direction and in the intersection direction, due to characteristics of the coil spring.

According to the aspect (6) of the present disclosure, it is possible to further stabilize a posture of the main body-side electrical contact part, as compared to a configuration in which the coil spring is one.

According to the aspect (7) of the present disclosure, it is possible to restrain a movement range of the main body-side electrical contact part while enabling the main body-side electrical contact part to move in the third direction and the direction intersecting with the third direction. As a result, it is possible to more easily approach and interconnect the drawer-side electrical contact part and the main body-side electrical contact part.

According to the aspect (8) of the present disclosure, the first protrusion is allowed to move only in the first notch, so that it is possible to restrain the movement range of the main body-side electrical contact part in the first direction.

According to the aspect (9) of the present disclosure, the first protrusion is allowed to move only in the first notch and the second protrusions are allowed to move only in the second notches, so that it is possible to restrain the movement range of the main body-side electrical contact part in the third direction. The movement range of the main body-side electrical contact part in the third direction is restrained at a total of three places of one place of the first notch and two places of the second notches, so that it is possible to suppress a situation in which the main body-side electrical contact part (panel) is applied with excessive load and is not thus moved.

According to the aspect (10) of the present disclosure, the excessive load is hardly applied to the main body-side electrical contact part (panel), so that smoother movement can be implemented.

According to the aspect (11) of the present disclosure, while the panel protrudes relative to the base in the third direction according to the pressing force, the first protrusion can move only relatively small in the first direction. However, while the panel contracts (approaches the base) in the third direction against the pressing force, the first protrusion can move relatively large in the first direction. Therefore, it is possible to increase an allowable range of movement of the first protrusion in the first direction only when the main body-side electrical contact part and the drawer-side electrical contact part are in contact with each other. In other words, in other cases, it is possible to arrange the main body-side electrical contact part in a fixed position with accuracy. As a result, the main body-side connector and the drawer-side connector can be connected with accuracy.

According to the aspect (12) of the present disclosure, the panel is allowed to move in the fourth direction up to the position in which it contacts the protrusion, so that the movement range of the main body-side electrical contact part in the fourth direction can be restrained.

According to the aspect (13) of the present disclosure, the elastic member can be arranged in the internal space of the ear part. Therefore, the panel can be pressed in outermore positions of the base and the panel in the first direction. Thereby, it is possible to stabilize the posture of the main body-side electrical contact part.

According to the aspect (14) of the present disclosure, the panel can be pressed in outermore positions of the base and the panel in the first direction. Thereby, it is possible to further stabilize the posture of the main body-side electrical contact part.

What is claimed is:

1. An image forming apparatus comprising:

a drum cartridge comprising:

a frame configured to hold a photosensitive drum rotatable about an axis extending in a first direction;

a drum memory storing at least one of information about the photosensitive drum; and a drum-side connector located at an outer surface of the frame on one side, the drum-side connector comprising:

a drum-side electrical contact part electrically connected to the drum memory; and a socket configured to hold therein the drum-side electrical contact part, the socket extending in a second direction; and an image forming apparatus main body comprising:

a main body-side connector comprising:

a main body-side electrical contact part being contactable the drum-side electrical contact part in case the drum cartridge is inserted in the image forming apparatus main body; and a holder comprising:

a base;

a panel, the main body-side electrical contact part being attached to the panel; and an elastic member positioned between the base and the panel, the holder being configured to hold the main body-side electrical contact part to be movable in an intersection direction intersecting with an extension and contraction direction of the elastic member, wherein in a case the holder is in contact with the socket of the drum-side connector, the panel moves relative to the base in the intersection direction together with the main body side-electrical contact part, and the main body side-electrical contact part and drawerdrum-side electrical contact part are in contact with each other.

2. The image forming apparatus according to claim 1, wherein the holder is further configured to hold the main body-side electrical contact part to be movable in the second direction.

3. The image forming apparatus according to claim 2, wherein the intersection direction and the second direction are orthogonal to each other.

4. The image forming apparatus according to claim 1, wherein the holder is configured to press the main body-side electrical contact part toward a first side in the second direction.

5. The image forming apparatus according to claim 4, wherein the holder is configured to press the main body-side electrical contact part by using a coil spring as the elastic member.

6. The image forming apparatus according to claim 5, wherein the coil is provided to interpose the main body-side electrical contact part therebetween and is configured to press the electrical contact part in two positions of a first side and a second side in the first direction.

7. The image forming apparatus according to claim 1, wherein the holder comprises:

the base comprising:

a first contact surface that is a flat surface-shaped part perpendicular to the second direction; and a first spring seat, one end of the elastic member in the second direction being connected to the first spring seat;

a cover fixed to the base with being overlapped in the second direction; and the panel comprising:

an attachment part, the main body-side electrical contact part being attached to the attachment part;

a second contact surface contactable the first contact surface; and a second spring seat, the other end of the elastic member in the second direction being connected to the second spring seat, and wherein the holder is configured to restrain a movement range of the panel relative to the base and the cover.

8. The image forming apparatus according to claim 7, wherein the cover comprises:

a pair of first sidewalls facing each other in the first direction; and a pair of second sidewalls facing each other in a third direction, the third direction being perpendicular to the first direction and the second direction, wherein one of the pair of second sidewalls has a first notch opened on a side facing the base, wherein the panel has a first protrusion extending in the third direction, and wherein the first protrusion is accommodated in the first notch with a gap being formed in the first direction between an outer peripheral surface of the first protrusion and an inner surface of the first notch.

9. The image forming apparatus according to claim 8, wherein the other of the pair of second sidewalls of the cover has second notches located at both sides thereof at positions distant from a position facing the first notch in the first direction, each of the second notches being opened at a side facing the base, wherein the panel has second protrusions extending in the third direction, and wherein the second protrusions are respectively accommodated in the second notches.

10. The image forming apparatus according to claim 9, wherein when seen in the second direction, the first notch and the two second notches are respectively arranged at apexes of an isosceles triangle.

11. The image forming apparatus according to claim 8, wherein a width of the first notch in the first direction gradually decreases away from the base in the second direction.

12. The image forming apparatus according to claim 8, wherein the cover comprises:

a flat surface extending in a rectangular shape toward an inner side of the cover from end portions of the pair of second sidewalls which are opposite to the base in the second direction; and a protrusion protruding from an inner edge of the flat surface toward the inner side of the cover in the third direction, and wherein movement of the main body-side electrical contact part and the panel in the third direction allowing a part of the protrusion to be in contact with an outer surface of the panel in the third direction.

13. The image forming apparatus according to claim 8, wherein the panel comprises ear parts arranged at both sides thereof in the first direction with the attachment part being positioned therebetween, wherein each of the ear parts has a concave portion opened toward the base, and wherein the second spring seat is provided in the concave portion.

14. The image forming apparatus according to claim 13, wherein the pair of first sidewalls each has a third notch opened at a side facing the base, and wherein each of the ear parts extends in the first direction through the respective third notch.

15. The image forming apparatus according to claim 1, wherein a developing cartridge for accommodating toner therein is removably insertable to the frame, wherein toner identification information identifying the developing cartridge and toner life-span information are stored in the drum memory, and wherein the drum-side connector and the main body-side connector are configured to be interconnected to relay communication between the drum memory and a controller of the image forming apparatus.

16. The image forming apparatus according to claim 1, wherein the image forming apparatus further comprises a controller being electrically connected to the main body-side electrical contact part, wherein drum identification information identifying the photosensitive drum and drum life-span information are stored in the drum memory, and wherein the drum-side connector and the main body-side connector are configured to be interconnected to relay communication between the drum memory and the controller.

* * * * *